US008621803B2

(12) United States Patent
Efros

(10) Patent No.: US 8,621,803 B2
(45) Date of Patent: Jan. 7, 2014

(54) STRUCTURAL INTERLOCKING WOOD PANEL

(76) Inventor: Anatoli Efros, Los Angeles, CA (US)

( * ) Notice: Subject to any disclaimer, the term of this patent is extended or adjusted under 35 U.S.C. 154(b) by 0 days.

(21) Appl. No.: 13/293,009

(22) Filed: Nov. 9, 2011

(65) Prior Publication Data

US 2013/0111839 A1 May 9, 2013

(51) Int. Cl.
*E04F 13/08* (2006.01)

(52) U.S. Cl.
USPC ..... 52/391; 52/390

(58) Field of Classification Search
USPC ..... 52/379, 384, 390, 391, 392, 403.1, 52/407.3
See application file for complete search history.

(56) References Cited

U.S. PATENT DOCUMENTS

| | | | | | |
|---|---|---|---|---|---|
| 1,454,250 | A | * | 5/1923 | Parsons | 52/391 |
| 1,622,103 | A | * | 3/1927 | Fulton | 52/390 |
| 2,088,238 | A | | 7/1937 | Greenway | |
| 3,535,839 | A | * | 10/1970 | Strubing | 52/99 |
| 3,908,053 | A | * | 9/1975 | Hettich | 428/44 |
| 4,543,765 | A | | 10/1985 | Barrett | |
| 4,571,353 | A | | 2/1986 | Gable | |
| 4,731,140 | A | * | 3/1988 | Yontrarak | 156/154 |
| 5,822,947 | A | | 10/1998 | Tarrant | |
| 6,073,417 | A | | 6/2000 | Hackett | |
| 6,311,443 | B1 | * | 11/2001 | Allazetta | 52/392 |
| 6,449,913 | B1 | | 9/2002 | Shelton | |
| 6,740,388 | B1 | * | 5/2004 | Koket | 428/100 |
| 6,799,402 | B2 | * | 10/2004 | Faxe et al. | 52/390 |
| 7,802,415 | B2 | | 9/2010 | Pervan et al. | |
| 2002/0170257 | A1 | | 11/2002 | McLain et al. | |
| 2006/0032168 | A1 | * | 2/2006 | Thiers et al. | 52/390 |
| 2009/0025308 | A1 | | 1/2009 | Deans et al. | |
| 2009/0260307 | A1 | * | 10/2009 | Thiers | 52/309.1 |
| 2010/0242394 | A1 | | 9/2010 | Price | |

FOREIGN PATENT DOCUMENTS

| | | | |
|---|---|---|---|
| JP | 11294787 | A | 10/1999 |
| JP | 2005036640 | A | 2/2005 |

OTHER PUBLICATIONS

International Search Report of Apr. 24, 2013.

* cited by examiner

*Primary Examiner* — James Buckle, Jr.
(74) *Attorney, Agent, or Firm* — Fulwider Patton LLP

(57) ABSTRACT

A composite membrane of wood floor diaphragm for construction of new buildings and strengthening of existing buildings to provide improved load transfer capacity and enhanced resistance to gravity and lateral loads, such as earthquake and/or wind for buildings with wood floor framing. The aforementioned composite membrane is a system, comprised of four-way interlocking mosaic end grain parquet floor attached to a plywood subfloor beneath. A floor to floor sound blocking barrier that can operate in high eighty decibel and above range may preferably be installed under the subfloor.

16 Claims, 26 Drawing Sheets

3-D MODEL

STRUCTURAL INTERLOCKING WOOD PANEL

FIELD OF INVENTION

In general, this invention relates to the field of building construction. More particularly, the present invention relates to the following:

1. Composite membrane wood floor diaphragm for new buildings and strengthening of the existing buildings to provide improved load transfer capacity and resistance of membrane of wood floor diaphragm to gravity and lateral loads, such as earthquake and/or wind for buildings with wood floor framing; and 2. A sound suppression system installed beneath a plywood subfloor that offers floor-to-floor sound suppression operating in the eighty (80) to ninety (90) decibel range.

BACKGROUND OF THE INVENTION

According to the American Wood and Forest Association's "Details for Conventional Wood Frame Construction", wood frame construction continues to be the predominant method of constructing homes and apartments. This is due to the inherent strength and durability of wood frame buildings. Increasingly, wood framing is also being utilized in the construction of commercial and industrial mid-rise buildings. Wood frame buildings are economical to build and to heat and cool down, providing comfort for the occupants. Moreover, wood construction is readily adaptable to a wide variety of architectural building styles.

There are two (2) predominant styles of wood frame construction in the building industry: balloon and platform (see, e.g., FIGS. 1, 2, 3 and 4). In general, balloon framing is a technique that suspends the floors from the walls. Vertical wood studs extend the full height of the walls of a balloon frame building, and floor joists are fastened to the studs with nails. Balloon construction is a system of framing a wooden building, whereby all vertical structural elements of the exterior bearing walls and partitions consist of single studs that extend the full height of the frame, from the top of the sill plate to the roof plate, and all floor joists fasten by nails to the studs.

The balloon-frame house with wood cladding, invented in Chicago in the 1840s, aided the rapid settlement of the western U.S. The introduction and ensuing popularity of balloon frame construction coincided with the intensification of the settlement of Wisconsin and the opening of Wisconsin's forests to the lumber industry. By 1892, the vast amount of milled lumber available made balloon frame construction an inexpensive and expedient choice for Wisconsin builders, and wood frame buildings of all descriptions became ubiquitous on the landscape. This method of construction was common until the late 1940s.

The balloon style of construction has mostly been discontinued due to a number of factors, including, but not limited to the overall low fire resistance and the high cost of lengthy studs, which together inhibits the use of the balloon method of construction in multi-story buildings. This led the industry to the platform style of construction, in which each floor of the building is built as a separate unit from floors above and below it. In North America, with its abundant softwood forests, the framed building received an extensive revival after World War II in the form of platform framing. Since that time, platform framing has become the predominant form of wood frame construction.

In a contemporary multi-story building, a general platform construction sequence can be briefly described as follows. Reference is made to FIGS. 1, 2, 3 and 4. FIG. 1 shows a typical section view cut through the exterior bearing wall, where the floor framing is perpendicular to the exterior wall. This typical section (FIG. 1) pertains to a platform construction and illustrates a typical floor joist bearing over the bearing one-sided shear wall below with an upper story bearing shear wall above, conceptually showing typical/standard gravity and lateral load transfer connections, structural floor diaphragm and other major non-structural elements, such as exterior stucco, drywall and flooring, etc.

FIG. 2 shows a typical section view cut through the interior bearing wall where the regular wood joist floor framing on the left side is parallel to the subject wall below and above and the wood framing on the right hand side is perpendicular to the interior wall above and below. This typical section pertains to platform construction and it illustrates a typical floor joist bearing over the bearing one-sided shear wall below with an upper story bearing shear wall above, conceptually showing typical/standard gravity and lateral load transfer connections, structural floor diaphragm and other major non-structural elements (such as exterior stucco, drywall and flooring, etc.).

Upon completion of the earthwork (i.e., excavation for the foundation), a foundation is typically laid and installed. Thereafter, first floor walls are erected, ending with a double top plate 4 on top of the studs 1. Then, the floor framing elements, such as floor joists 3 and blocking 7, or floor joists 26 and blocking 28 and 29 if an engineered wood framing system is utilized, are added. The subfloor plywood 11 is then constructed. Subfloor 11 is generally defined in the construction industry as "rough" floor, typically plywood, over which flooring material 18 is laid. Subfloor membrane 11 is attached to the floor framing system below with fasteners 24 in accordance with the floor diaphragm fastening schedule, forming a structural floor diaphragm that is defined and discussed in a greater detail below. After the second floor base plate 8 is installed over the subfloor, the wall studs 2 go up to the third-floor level to a top plate again. Over that top plate, the process is repeated for the next floor up and so forth. The ceiling structure at the roof level and the rood structure itself are installed over the very last double top plate. Once rough framing of the structure is complete (i.e., the structure skeleton is erected), including but not limited to the installation of shear transfer hardware 6 and 9, then other non-structural elements of the building, such as but not limited to exterior stucco 12, exterior building paper and wire mesh 13, interior drywall sheathing 14, wall thermal insulation 15, floor thermal insulation 16, and interior drywall ceiling sheathing 23 are scheduled for installation, traditionally postponing the installation of flooring material 18 towards the very end of the structure construction sequence.

The advent of contemporary construction technologies brought engineered wood to the construction industry market as an alternative material choice to the traditional wood. Engineered wood products, see FIGS. 3 and 4, are typically used in a host of structural applications, ranging from home construction to agricultural buildings to large commercial structures.

FIG. 3 shows a typical section view cut through the exterior bearing wall where an engineered wood I-beam floor framing is perpendicular to the exterior wall. This typical section pertains to platform construction and it illustrates a typical engineered wood I-beam floor joist bearing over the bearing one-sided shear wall below with an upper story bearing shear wall above, conceptually showing typical gravity and lateral load transfer connections, structural floor diaphragm and other major non-structural elements, such as exterior stucco, drywall and flooring, etc.

FIG. 4 shows a typical section view cut through the interior bearing wall where an engineered wood I-beam floor joist framing on the left side is parallel to the subject wall below and above and an engineered wood I-beam floor framing on the right hand side is perpendicular to the interior wall(s) above and below. This typical section pertains to platform construction and it illustrates a typical engineered wood I-beam bearing over the bearing one-sided shear wall below with an upper story bearing shear wall above, conceptually showing typical gravity and lateral load transfer connections, a structural floor diaphragm membrane, and other major non-structural elements such as exterior stucco, drywall and flooring, etc.

In both residential and commercial construction, engineered wood products are typically used in longer span floors with reduced or limited deflection criteria, walls, and roofs. Use of engineered wood applications have not introduced any principal changes to the normal platform construction sequence briefly described above.

Blocking noise from floor-to-floor is the most common, yet challenging request in soundproofing. While a lack of a desired level of floor sound suppression persists in the construction industry, the current industry interpretation of the term "sound barrier" refers to a system that decreases propagation of sound traveling through the floor system. Regretfully, sound suppression continues to play role of a sound or noise propagation control rather than a sound barrier system.

Rick Berg's article "Using a Sound Barrier With Wood Flooring" in the June/July 2002 edition of Hardwood Floors Magazine recognizes significant ongoing customer demand for a ". . . better job of controlling sound transmission between living quarters," noting that building codes typically specify two types of sound-control ratings: IIC (Impact Insulation Class) and STC (Sound Transmission Class). A rating of 50 decibels for each class is generally is a standard requirement. The IIC class relates to sound transmitted as a result of impact on a surface, such as footsteps on a floor for example. The STC class relates to airborne sounds, such as voices and music. Sound control underlayments often carry an STC rating, as well as an IIC rating. However, flooring products really have a substantial effect only on impact sounds.

The aforementioned article reveals that "in some cases, we've seen developers asking for a IIC in the 60s. . . . Sometimes you can achieve that in a concrete structure with suspended ceilings, but you can't expect to be in the 60s with a wood-frame structure. The structure itself limits that." In reality, a rating in the range of 50 decibels or even 60 decibels for wood frame structures is well below the desired range of high 80 decibels or even 90 decibels. Current art pertinent to the acoustic materials in the industry include materials for sound insulation in wood frame construction that typically rely on employing of one (1) or more types of noise propagation reduction systems from the following general list:

1. Use of actual flooring materials as soundproof material. Obviously, and as said in the aforementioned article, different flooring materials have very different sound transfer qualities. Carpet flooring, for an example, is a material with one of the highest soundproof ratings. However, it is highly problematic due to a number of factors, including, but not limited to, the major known issues of indoor air quality, and serviceability issues associated with particle residue retained between the carpet pad and carpet itself. Such residue is known to cause allergies, breathing problems, respiratory infections and asthma. Furthermore, accumulation of moisture and, as a consequence, most likely growing bacteria such as mold that is not removable by means of regular cleaning, creates a major problem for the consumers, not to mention the overall high maintenance factor.

2. Use of sound control underlayment, such as cork or even an engineered noise control insulation mat that is intended to limit only a certain percentage of impact noise between the floors. If sound control underlayment is employed, it is normally installed between the flooring 18 and plywood sheathing 11 (refer to FIGS. 1 to 4). Sound control underlayment is not called out in FIGS. 1 to 4 since it does not embody the industry standard or mandatory requirement in all the typical cases.

3. Interior drywall sheathing 23 per FIGS. 1 to 4 or, in older construction, use of so called acoustic ceiling, also known in the industry as "popcorn ceiling" instead of drywall sheathing 23. The "popcorn ceiling" can be found in some of the older structures since it was popular from the late 1950's through the early 1980's. Even if difficulty in cleaning and the issue of architectural appearance are negated and not considered as main factors against use of acoustic ceilings, the main prohibiting factor against this type of ceiling today is the presence of asbestos.

Interior drywall sheathing 23 itself is not very effective as a primary sound reduction system. Some local building and safety jurisdictions suggest addition of ⅝ inch gypsum board to the existing ceiling construction, while other jurisdictions, depending on building occupancy and other factors beyond the scope of this discussion, simply require doubling drywall sheathing 23 to achieve a satisfactory reduction in noise propagation. In either case, even a 0.5 inch thickness increase in ceiling board system essentially means an increase on the overall dead load of the floor system by 2.5 pounds per square foot. Obviously, such an approach offers a less than desirable solution from both the design gravity load standpoint and the design lateral load increase standpoint. Meanwhile, all of the systems described above offer a noise transmission reduction remedial solution that operate in the 50 decibel range or at the very best 60 decibel range.

Although the acoustic engineering society has made attempts in the past to work on finding a solution in form of an improvement in the current state of the art, the building community has created an opposition that has thus far blocked these attempts due to the increase in the cost of construction. However, a lack of a proper noise blocking barrier can lead to medical problems associated with exposure to noise. Complications, related to the exposure to certain levels of noise in different environments, may result in an undesirable outcome. For an example, exposure to noise in the hospital or at school is a nuisance that inflicts various negative impacts on patient's and student's nervous system.

Currently, the industry has not yet offered to the consumer a floor-to-floor noise blocking barrier that can operate in the high 80s decibel range or even 90 decibel range, despite the tendency toward higher population densities in urban areas. Privacy at home has become of greater importance, not to mention the rapidly developing trend of multi-level housing that brings the neighbor noise issue to the forefront, highlighting a need for exceptional, non-remedial solutions in form of an adequate noise blocking barrier.

In structural engineering, a diaphragm is generally defined as structural system used to transfer lateral loads to shear walls or frames primarily through in-plane shear stress. These lateral loads are usually the result of wind and earthquake loads, but other lateral loads such as lateral earth pressure or hydrostatic pressure can also be resisted by diaphragm action. Diaphragms are usually constructed of plywood or oriented strand board in timber construction, metal deck or composite metal deck in steel construction, or a concrete slab in concrete construction.

The Second Edition of Dictionary of Architecture & Construction by Cyril Harris defines a diaphragm as "A floor slab, metal wall panel, roof panel, or the like, having a sufficiently large in-plane shear stiffness and sufficient strength to transmit horizontal forces to resisting systems."

The diaphragm of a structure often does double duty as the floor system and roof system of a building, or the deck of a bridge, which simultaneously supports gravity loads. The common floor diaphragm serves a dual purpose by supporting vertical forces (from loads such as furniture, people, snow, uplift, and its own dead load) and by transmitting horizontal forces (from wind pressure or earthquake accelerations) to the vertical load resisting elements of the structure, such as the shears walls. In the wood frame structure, shear walls play the role of lateral support during the lateral load transfer action. In a common form of sheathed construction, the diaphragm membrane is usually a planar system of sheathing connected to the frame members, intended to act together to withstand considerable in-plane forces. Diaphragm stiffness is an important parameter in the design of wood framed structures to calculate the predicted deflection, and thereby determine if a diaphragm may be classified as rigid or flexible. The two primary types of diaphragms are identified in the industry as flexible and rigid. This classification controls the method by which load is transferred from the diaphragm to the supporting structure below. Flexible diaphragms resist lateral forces depending on the tributary area, irrespective of the flexibility of the members to which they are transferring force. On the other hand, rigid diaphragms transfer load to frames or shear walls depending on their flexibility and their location in the structure.

Parts of a diaphragm include: the membrane, used as a shear panel to carry in-plane shear; the drag strut member, used to transfer the load to the shear walls or frames; and the chord, used to resist the tension and compression forces that develop in the diaphragm, since the membrane is usually incapable of handling these loads alone.

According to the "HISTORY OF YARD LUMBER SIZE STANDARDS" by L. W. SMITH, Wood Technologist and L. W. WOOD, Engineer (Forest Service, U.S. Department of Agriculture), early standards called for green rough lumber to be of full nominal dimension when dry, but the requirements have changed over time. For example, in 1910, a typical finished 1-inch (25 mm) board was 13/16 inch (21 mm). In 1928, that dimension was reduced by 4%, and yet again by 4% in 1956. In 1961, at a meeting in Scottsdale, Ariz., the Committee on Grade Simplification and Standardization agreed to what is now the current U.S. standard: in part, the dressed size of a 1 inch (nominal) board is fixed at ¾ inch; while the dressed size of a 2 inch (nominal) lumber was reduced from 1⅝ inch to the today's standard of 1½ inch. Therefore, currently, typical 2× joist 3 is actually 1.5 inches thick.

More often use of the open space or open floor design concept in contemporary architectural designs require wood floor diaphragms to span farther and farther horizontally without a support (walls, column, etc.). In many cases, architectural design parameters create situations where walls above a floor are not aligned with or not located directly beneath the walls on that floor, thereby requiring certain parts of the floor diaphragm to be responsible for the lateral load transfer from walls above down to the walls below through the floor diaphragm. This situation automatically leads to development of higher stresses within the horizontal diaphragm. The same and/or similar challenges are described in the SEAOSC's article "Thinking Outside the Box: New approaches to very large flexible diaphragms" by John W. Lawson, SE of Kramer & Lawson, Inc. (Tustin, California). However, the aforementioned article notes that "wood roof diaphragms are being required to span farther horizontally with higher shear stresses."

It is certainly understood that especially high span, flexible wood diaphragm behavior is somewhat similar to the behavior of a beam subjected to bending (flexure). A horizontal wood diaphragm span between vertical supports, for example shear walls in the out-of-plane direction, as schematically shown on FIG. 6. Because of the beam-like behavior in the out-of-plane direction as schematically demonstrated in FIG. 6, lateral force 20 application throughout the diaphragm system causes a different type of stresses to occur within the different components of the diaphragm.

Besides the lateral forces (caused by earthquake, strong wind, etc.) that travel through the diaphragm and cause shear stresses, due to the beam-like behavior in the out-of-plane direction diaphragm, there are also forces or force components that occur in the membrane of the diaphragm and act in direction 49 as shown on FIG. 7 (also FIGS. 5A and 5C), imposing forces onto the plywood panels 11, perpendicular to the direction of the edge spacings 22 that run parallel to (or along) the direction of floor joist 3 or 26. Subject forces 49 imposed in the direction as shown in FIGS. 5B and 5D pull the plywood away, imposing forces in the same direction onto the fasteners 24. Force 49 is also perpendicular to the direction of lateral force 20 and, correspondingly, reaction (and shear transfer) force 41. This action, development and corresponding imposition of a sufficient amount of force in the direction 49 will cause excessive stresses in: (1) the most vulnerable area from the structural point region 37 of wood panel 11 on FIG. 5A and, correspondingly, region 41 on FIG. 5C; (2) fastener 22 on FIG. 5A and FIG. 5D; and (3) joist 3 of FIG. 5A or joist 26 on FIG. 5C, causing cracking or splitting 50 as schematically shown on FIG. 5B and FIG. 5D.

The issue (1) above can also occur if fasteners 24 are located too close to the edge of plywood panels. For a regular construction assembly where 2× framing such as 3 is used, based on the dimension 36 and 22, the dimension 37 would be approximately within one quarter inch. That is in the best case scenario, neglecting normal intolerances associated with field installation that happens routinely. The dimension 40 of FIG. 5C per current standards varies from 1¾ inch for TJI 110 joists to 3½ inches for TJI 560 joists. The heavier the joist 26, the longer the joist span and, correspondingly, the heavier the resulting diaphragm loads. This leads to the introduction of staggered fasteners, spaced closer when dimension 40 jumps to values higher than 1¾ inch. A staggered nailing pattern again leaves the same problem unresolved for at least 50% of the fasteners, located closest to the edge of panel 11, not offering much higher number than 37 on FIG. 5A, and fasteners 24 are still too close to the edge of plywood panels 11. Therefore, it is evident that the problem of fasteners 24 being too close to the edge of plywood panel 11 exist in both cases. This issue of fasteners 24 located too close to the edge of plywood panels 11 in this type of construction leaves an automatic failure path for plywood to tear through the nails and pull away, as shown on FIG. 5B and 5D.

Issue (2) is likely to result in an overstressing in fastener 22 to the point of loss of structural integrity and corresponding flexure (bending), as schematically shown on FIG. 5B and FIG. 5D. Issue (3) above shall be described as crack or split (separation) development 50 as schematically shown on FIG. 5B and FIG. 5D due to localized stress occurrence, caused by the force exerted by each fastener 24 in the row onto the joist 3 on FIG. 5A or joist 26 on FIG. 5C, in the direction of force 49, perpendicular to the wood grain as shown.

As also discussed in the aforementioned SEAOSC's article, a proposed remedy for issue (1) would be the "multiple lines of nails, on 3× and 3× framing, with special inspection." In addition, the following statement is made in the article: "As in all wood diaphragms, closely spaced nails that align with the wood grain could cause wood splitting that compromises the nail's gripping strength. The use of a staggered nailing pattern and wider framing members minimizes the risk of lumber splitting due to tight nail spacings." The subject statement reflects one current solution for both roof and horizontal floor diaphragm construction.

The industry standard 4 foot by 8 foot plywood panels 11 are to be typically installed in the wood diaphragm construction in the transverse direction (perpendicular) to the direction of floor joist. Panels 11 are typically staggered and edge spacing lines between plywood panels are thereby normally spaced every 4 feet apart. The aforementioned remedial solution suggests use of 3× or 4× framing at least every 4 feet where panel joints 22 occur. If framing joists are spaced at 16 inches on center, then every third member would be a 4× or 3× wood beam instead of the 2× joist. This offers an almost cost prohibitive, less than practical solution that also increases the dead load of the structure, inadvertently causing an increase in the design seismic load. Higher mass of the structure (dead load) simply means higher seismic load. The natural difference in stiffness between the typical 2× joist and a 4× or 3× wood beam used as a joist in case of uniform long floor diaphragm may also invite issues with uneven gravity load distribution and transfer within the floor system, posting unexpected potential issues with overall floor system long term performance. Obviously, use of 4× or 3× wood beams do not offer an acceptable solution for the issues (1), (2) and (3) above.

As also mentioned earlier, flooring material is traditionally not a part of the structural system of typical wood frame building. Normally, flooring material is not accounted for by the building designers to structurally resist gravity or lateral loads. From a structural standpoint, flooring self-weight or dead load is simply an additional mass to be considered for the gravity and lateral load design of the floor system as part of the structure and, consequently, design of corresponding portions of the structure responsible for carrying and resisting extra loading exerted by this mass.

The average life expectancy of a regular wood structure is in the neighborhood of one hundred years, depending on a number of factors. Throughout the life of the structure, it is usually expected that flooring will be changed periodically. Frequency of removal and replacement with new flooring normally depends on the type and overall serviceability and durability of the flooring material. Traditionally, flooring material in the industry is not used as part of the structural system of the building, often, carpet flooring is installed temporarily, solely to expedite the escrow closure process during the property acquisition and/or in efforts to obtain a formal certificate of occupancy in the new or remodeled building.

Not utilizing flooring as part of the structural system of the building traditionally creates challenges in the industry, including, but not limited to, moot points during the design phase. The structure is designed to carry a certain weight. Whether the structure is designed to carry 1 pound per square foot or 15 pounds per square foot weight of the floor makes a major difference. Often times, not being able to define and, therefore, not knowing the weight of the flooring material while the architectural design decisions related to the flooring choice has not been made or is being changed numerous times during the design process inserts a definiteness issue between the offices of the architect and the engineer. It is the engineer who is simultaneously estimating the structural design of the building, often times not knowing and only assuming a certain weight of the flooring material. This negatively affects both cost of the design and cost of the project during the construction phase. Conservative design for an additional weight may not always represent the safest and most economical design.

To summarize, putting aside the aforementioned challenges that transpire during the design phase due to lack of knowledge of the material weight while designing the actual structure, not utilizing flooring material as part of the structure creates a situation in the industry where flooring material is an afterthought that constitutes merely a burden to the structure of the building, an additional or added extra weight to be carried from the gravity load and lateral load transfer standpoints, without any participation in load resistance.

Strengthening or seismic rehabilitation of the diaphragms in the existing structures as part of the overall seismic strengthening program for the existing buildings is an important development in the current building industry that presents additional challenges. Reference is made to the Chapter 22 of "Diaphragm Rehabilitation Technique" of FEMA 547, and "Techniques for the Seismic Rehabilitation of Existing Buildings". Although the aforementioned document also states that "Diaphragm failures are less commonly observed in earthquakes," the same document reveals a significant problem related to "the disruption caused by strengthening the diaphragm [that] can be quite significant, so diaphragm rehabilitation is less commonly employed than adding global strength and stiffness, or improving connection paths."

In general, FEMA 547 calls inadequate diaphragm strength and/or stiffness as a main deficiency to be addressed by FEMA's rehabilitation technique. FEMA 547 refers to the addition of new wood structural panel sheathing as the "traditional and common approach to diaphragm strengthening," also stating that "adding fastening and blocking to existing wood structural panel sheathing can also be done." Furthermore, FEMA 547 on page 22-1 specifically calls for and describes the following proposed techniques:

I. Replacing existing sheathing with new wood structural panel sheathing.

II. Wood structural panel sheathing overlays with new blocking

III. Wood structural panel sheathing overlays without new blocking

Although FEMA 547 addresses the existing wood structural panel diaphragm related issues, mentioning that "an issue that often arises is whether existing joists, which are typically thicker than the code assumed 1½", can count as 3× blocking. Some engineers ratio values between 2× and 3× code capacities . . . " The specific problem, associated with stresses caused by the force 49 (see FIGS. 5A, 5B and 6), that occur in the existing wood structural panel diaphragm as described above, is not mentioned.

Another problem related to the use of the proposed remedies by FEMA such as the wood structural panel sheathing overlay technique(s) is the imposition of permanent weight (dead load) onto the existing structural system that may be incapable of carrying such additional dead load without strengthening and/or structural alterations. Although FEMA 547 states that "adding structural wood panel sheathing over existing sheathing adds weight to diaphragm . . . this rarely poses a problem," it is said thereafter that " the engineer should consider the issue." Since plywood weight is equal to 3 pounds per square foot per inch of thickness, even the addition of a ⅝ inch thick plywood panel overlay will cause a permanent increase in the dead load by at least 2 pounds per square foot. Without analysis of the existing structure and possible strengthening of the gravity load resisting system of the existing structure, such an increase in dead load creates an additional burden in form of the overstress, excessive deflections, or in some rare cases even a so called near failure state situation within the existing gravity load resisting system that exists in the older buildings.

Inasmuch as there has been worldwide attempts to develop conceptually new earthquake resisting systems for the buildings, such attempts are mainly focused on vertical earthquake resisting elements. The floor diaphragm as part of the structural earthquake resisting system attracts less attention than vertical earthquake resisting elements, such as shear walls, moment resisting frames, braced frames, etc.

SUMMARY OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

One object of this invention is an introduction of a composite membrane of a structural wood floor diaphragm comprised of an end grain mosaic parquet floor directly attached to a plywood subfloor by means of a high strength adhesive. As a result of creating the aforementioned composite membrane of structural wood floor diaphragm, flooring material is being employed to positively contribute to the structural system of a new or existing wood diaphragm of a building by means of its participation in gravity and lateral load resistance action, as well as a lateral load transfer mechanism. Thereby, flooring material is being included into the actual structural system of the new or existing wood frame building.

Another object of this invention is an introduction of four-way interlocking parquet designs denoted "Single Board Basket Weave" and "Double Board Basket Weave," respectively. Both of these designs are made from sizes of long components such as, for example, 3 inches by 9 inches, 3 inches by 12 inches, or 2¼ inches by 9 inches, and small components about 3 inches by 3 inches or 2¼ inches by 2¼ inches. Design "Double Board Basket Weave" has a higher structural strength due to the fact that all long components are doubled and glued together.

Another object of this invention is an installation of parquet designs "Single Board Basket Weave" and "Double Board Basket Weave" over a plywood subfloor diagonally while long components (9 inches to 12 inches in length) create a bridging over the edge spacing between plywood panels, holding those plywood panels together and providing reinforcement of this vulnerable region within a plywood subfloor. For the new building construction as well as for the purposes of strengthening (rehabilitation) of the plywood panel diaphragms of the existing buildings, a mosaic parquet floor system does not continue under the wall framing. This bridging action provides an improved resistance to forces in a direction perpendicular to the direction of in-plane lateral (seismic or wind) diaphragm force application, thus improving resistance to the initial tributary seismic or wind forces applied to the floor diaphragm. This installation noticeably improves the ability of the wooden diaphragm to withstand adverse lateral load conditions caused by earthquake and/or strong wind.

Another object of this invention is to demonstrate a system for installing flooring material in a new wood framed building after completion of the plywood subfloor installation, extending the flooring material all the way underneath the succeeding wall framing, but prior to the construction of the subsequent floor wall framing. This installation system provides advanced improvement in a diaphragm's capacity to withstand lateral loads by increasing shear load resistance capacity in the direction parallel to the wall by installing shear transfer connectors all the way through the entire composite membrane of the wood diaphragm, rather than just plywood sheathing alone.

Another object of this invention is the introduction of a multi-purpose sound barrier system that will offer a floor-to-floor noise blocking barrier that can operate in the high 80 decibel or even 90 decibel range. This multi-purpose sound barrier system is installed in the free space between the floor joists. This system also serves the dual purpose of floor thermal insulation and fire protection. The multi-purpose sound barrier system may be used in new building construction and can further be utilized during the course of strengthening (rehabilitation) existing buildings wherever space access between the floor joists is feasible.

There are essentially three kinds of glue joints of the wood:

End to end, which has the lowest bonding strength;

End to edge, which has a medium bonding strength; and

Edge to edge, which has the highest bonding strength.

In view of the foregoing, another object of the invention is a wooden membrane in the form of an end grain mosaic parquet construction, where all the joints of the components are edge to edge and made in sizes from 2 inches to 12 inches to provide a high number of glue joints, which will increase structural strength of such construction.

A preferred embodiment of the foregoing parquet construction involves making this end grain mosaic parquet membrane from Douglas fir, because of its relatively high density, large sizes of the trees, and plentiful supply of such timber.

Another object of this innovation is making an end grain parquet flooring 0.53 inches thick, which will become 0.50 inches thick after sanding. This thickness is a preferred parameter for being part of composite membrane of wood structural diaphragm due to its stiffness compatibility with plywood.

Another object of this invention is reprocessing of Douglas fir lumber through its heat treating. During this process, due to high temperatures (e.g., over two hundred degrees Celsius), cells of the wood collapse and melt together. As a result, moisture cannot travel through the wood, making it highly moisture-resistant, and allows usage of such lumber in exterior conditions. During the heat treating process, all resin, as a part of Douglas fir, bakes out, making the wood porous and therefore, increases its gluing capacity. This process also removes the sugars and resins that provide a food source for mold, mildew, rot, and insects. The heat treatment also causes the wood to become more porous as the sugars and resins are removed, making the gluing process more effective.

Another object of this invention is utilizing different regimes of heat treating process (variations of temperatures and duration of the process) which will provide numerous color variations of heat treated Douglas fir, allowing a production of many aesthetically pleasing products.

Another object of this invention is utilizing an adhesive for an application between all components of parquet panels with a high structural strength after its curing. This adhesive should have a level of viscosity that can be placed by an application and remain inside those spaces. This adhesive should have an open time window between 45 to 90 minutes, and after its curing, gain rigidity while still having a sufficient degree of elasticity to be able to deform reversibly under stresses within glue joints to allow a certain degree of in-plane flexibility in order to permit minor deformations of the entire flexible composite wood membrane system due to its expected movement under lateral forces applied to the diaphragm.

Another object of this invention is a method of preparation of mosaic parquet panels for its installation, while an adhesive is applied between each joint of all components of the panels.

Another object of this invention is a method of an application of parquet panels and transverse and longitudinal boards over a plywood subfloor by placing them over an adhesive, beginning a distance about 1" from its final position and sliding each component over the adhesive into its final position. This sliding movement provides an even distribution of adhesive underneath the panels and will force excess adhesive to be pushed through the edges to the surface, filling all spaces of the joints between panels, transverse and longitudinal boards, providing an ideal glue bond of the entire parquet membrane.

Another object of this invention is the coloring of both adhesives (for panel application and parquet installation.) Color of those adhesives should be comparable with the color of growth rings of Douglas fir after its finishing.

An object of this invention is a protection of installed parquet flooring by applying pressure sensitive covered plastic tape over unprotected areas of the flooring, which allows the flooring to be unfinished indefinitely during construction process, regardless of area of installation (inside/interior or in outside conditions before walls and roofs are installed).

Another object of this invention is the application of an adhesive to all components of parquet panels to attain structural strength after its curing. This adhesive has a level of viscosity that can be placed by an application and remain inside those spaces. This adhesive has an open time window between 45 to 90 minutes, and after curing, gain rigidity while still having sufficient degree of elasticity.

Another object of this invention is a method of preparation of mosaic parquet panels for its installation, while an adhesive is applied between each joint of all components of the panels.

Another objective of this invention is the coloring of both adhesives (for panel application and parquet installation). Color of the adhesives should be comparable with the color of the wood after its finishing.

Another object of this invention is a protection of an installed parquet flooring by applying a pressure sensitive covered plastic tape over the unprotected areas of the flooring, which allows the flooring to be unfinished indefinitely during construction process.

Another object of this invention is a multi-purpose sound barrier system that will offer a floor-to-floor noise blocking barrier that can operate in the high 80s decibel level or even 90s decibel range. This multi-purpose sound barrier system is to be installed in the free space between the structural elements; such as, for example the steel beams supporting the concrete slab. This system also serves a dual purpose of floor thermal insulation and fire protection. The aforementioned multi-purpose sound barrier system is intended for new building construction, and can be utilized to reinforce existing buildings wherever space between the structural elements and supporting concrete slab is accessible.

Another object of this invention is a packaging of assembled mosaic parquet panels and its individual components, which are not a portion of the panels within one hour after its assembly. Packages are sealed by tape similar to the tape that is used in the parquet assembly. Such packaging is important to protect the end grain wood from absorbing moisture or otherwise be affected by humidity changes that can lead to expansion or shrinkage of the boards.

Another object of the invention is the placing of end grain mosaic parquet panels or boards and individual components inside a wrap or sealed container and kept in such wrap or sealed container until approximately one hour before installation. Keeping the panels wrapped or sealed in a container prevents changes in the dimensions of the panels which can lead to difficulties during the installation process.

BRIEF DESCRIPTION OF THE DRAWINGS

In order to better explain the characteristics of the invention, the following preferred embodiments are described as an example only without being limitative in any way, with reference to the accompanying drawings, in which.

DETAILED DESCRIPTION OF THE PREFERRED EMBODIMENTS

Figure 2:
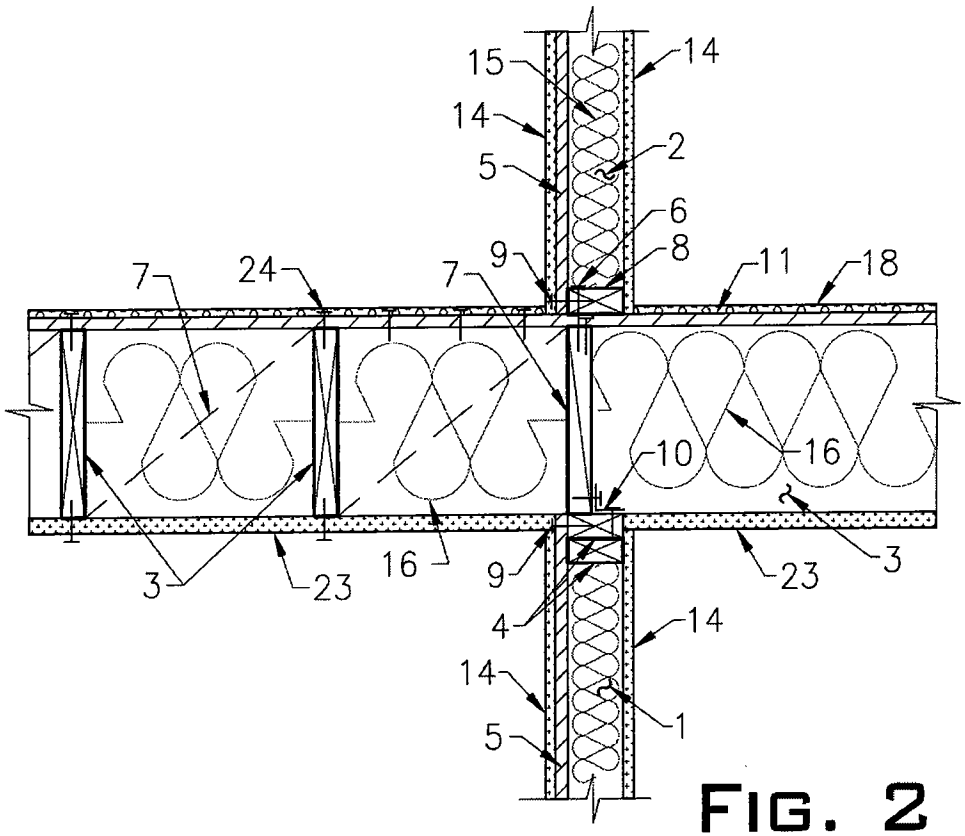
FIG. 2 (PRIOR ART)
FIG. 1 to FIG. 6 show prior art constructions.
Figure 1:
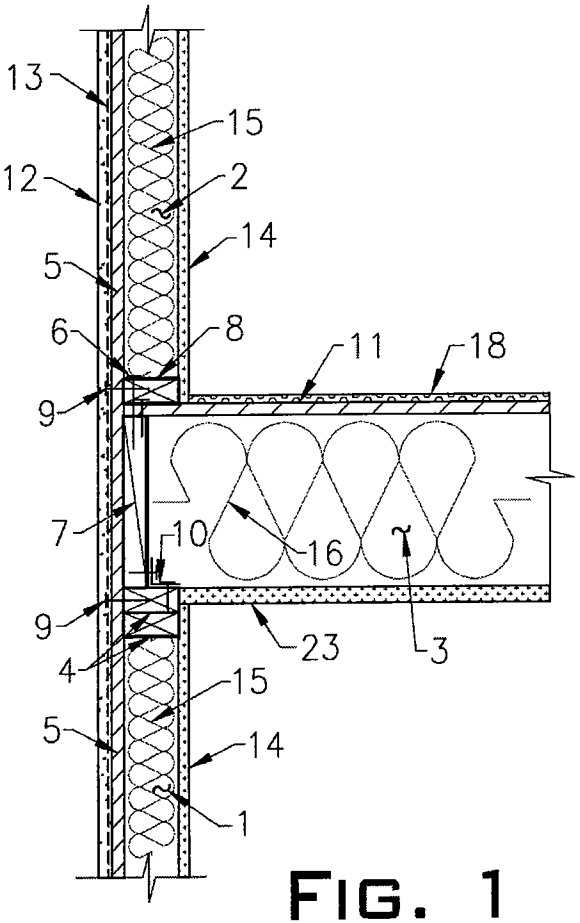
FIG. 1 (PRIOR ART)
Figure 4:
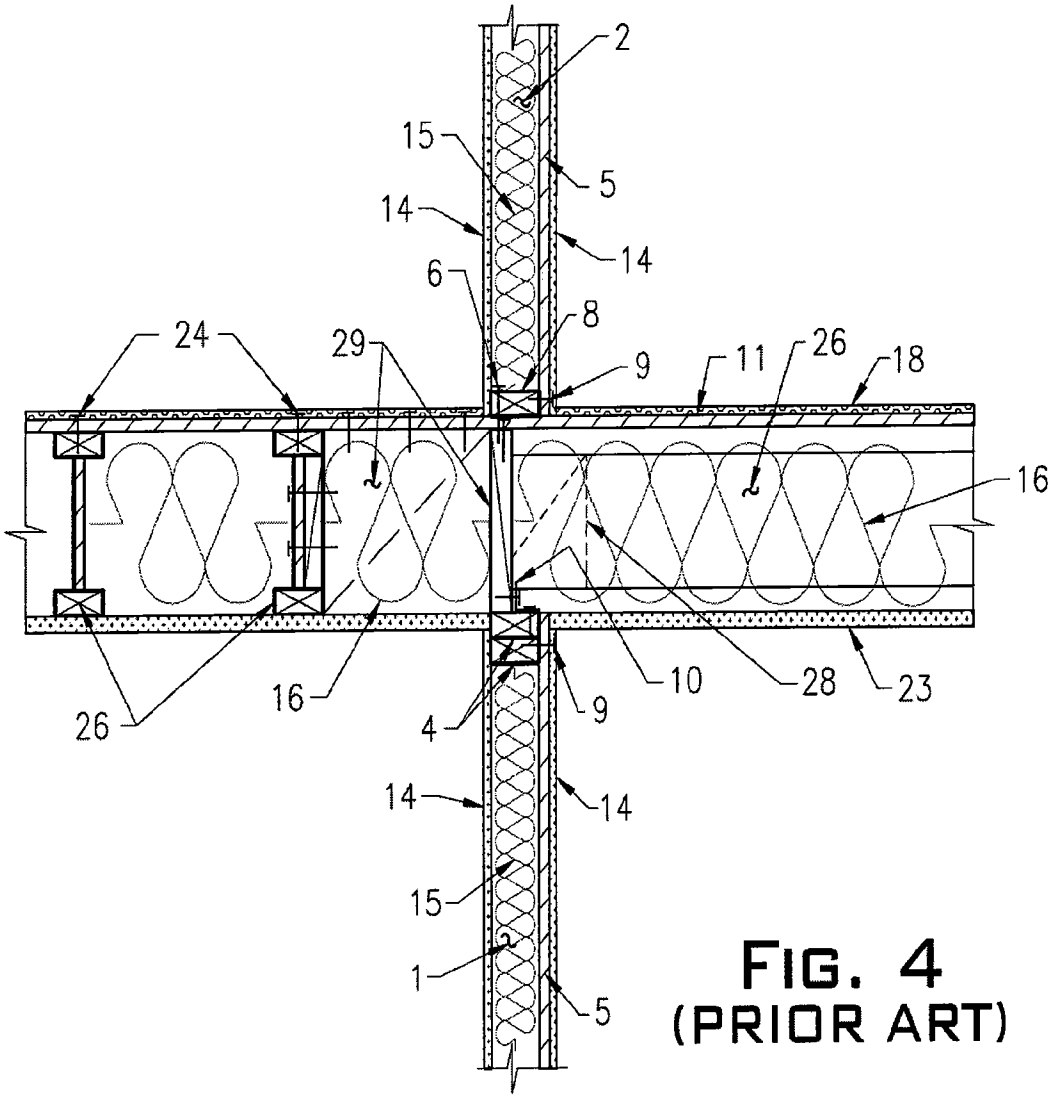
FIG. 4 (PRIOR ART)
Figure 3:
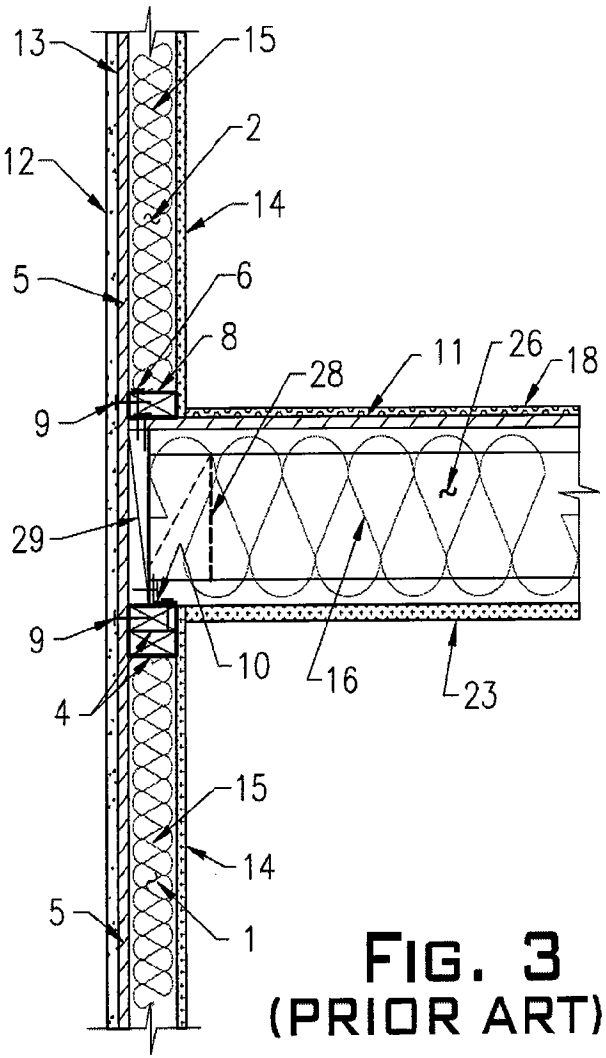
FIG. 3 (PRIOR ART)
Figure 5B:
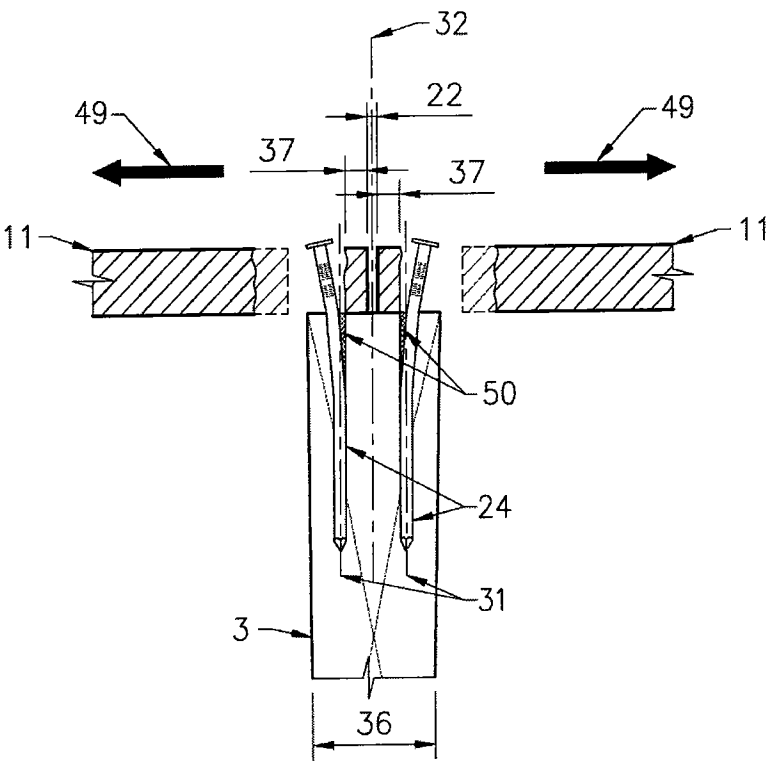
FIG. 5B (PRIOR ART)
Figure 5A:
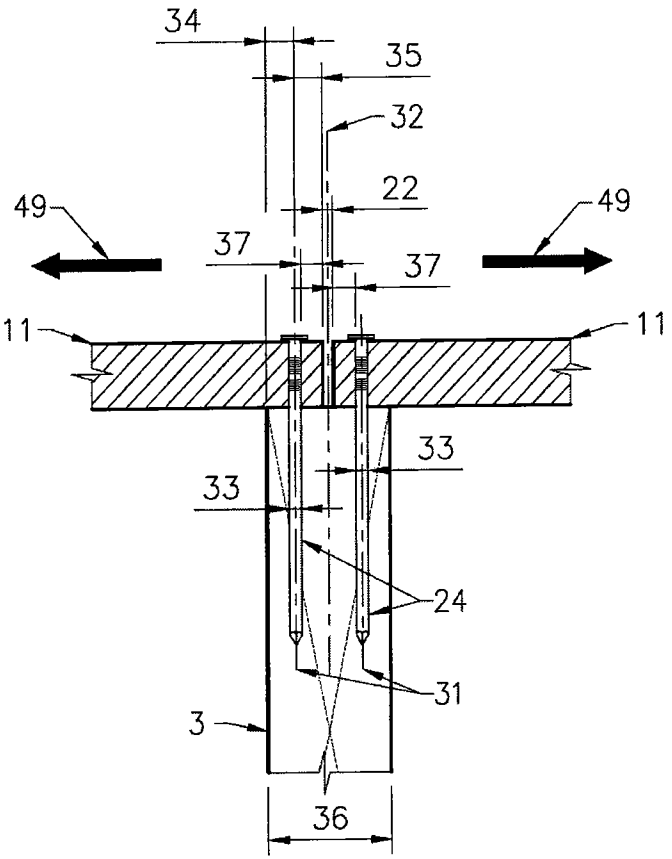
FIG. 5A (PRIOR ART)
Figure 5D:
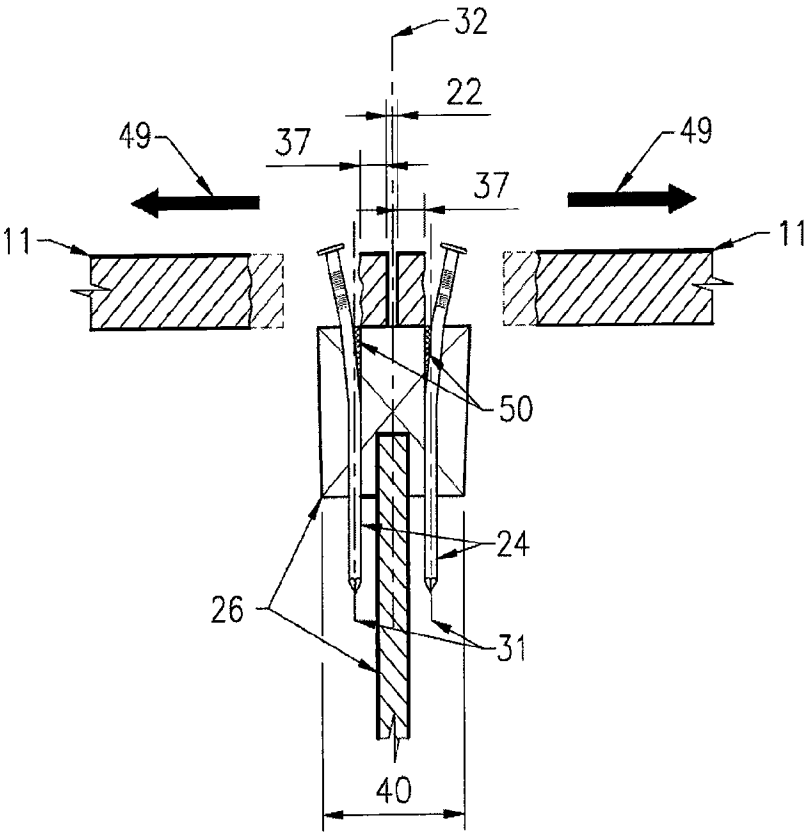
FIG. 5D (PRIOR ART)
Figure 5C:
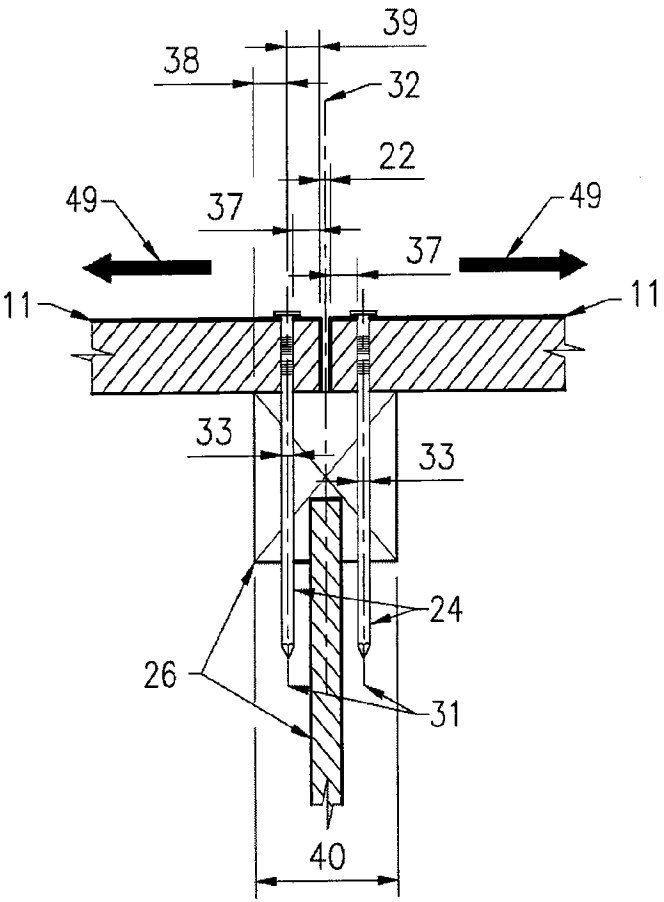
FIG. 5C (PRIOR ART)
Figure 6:
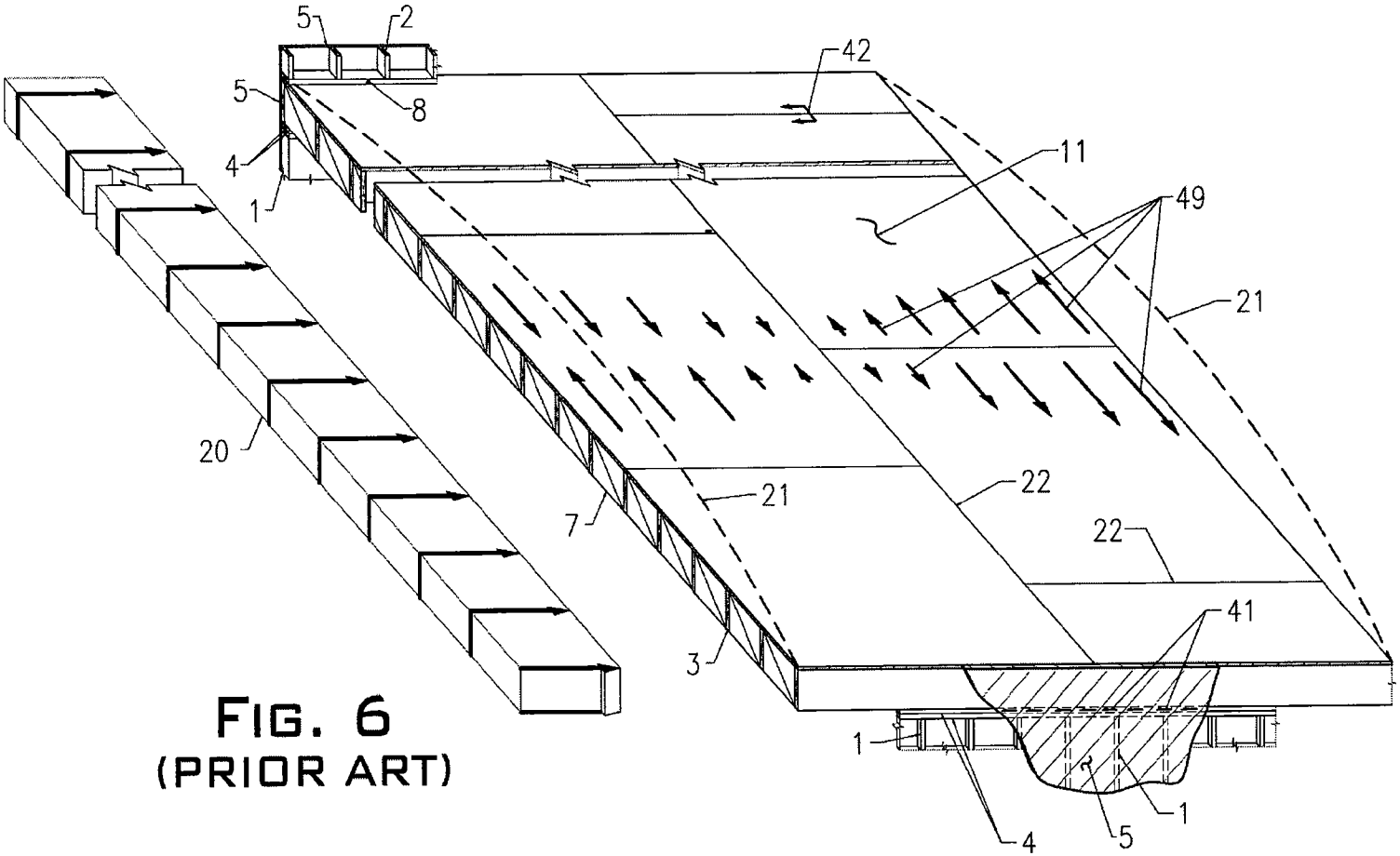
FIG. 6 (PRIOR ART)
Figure 7:
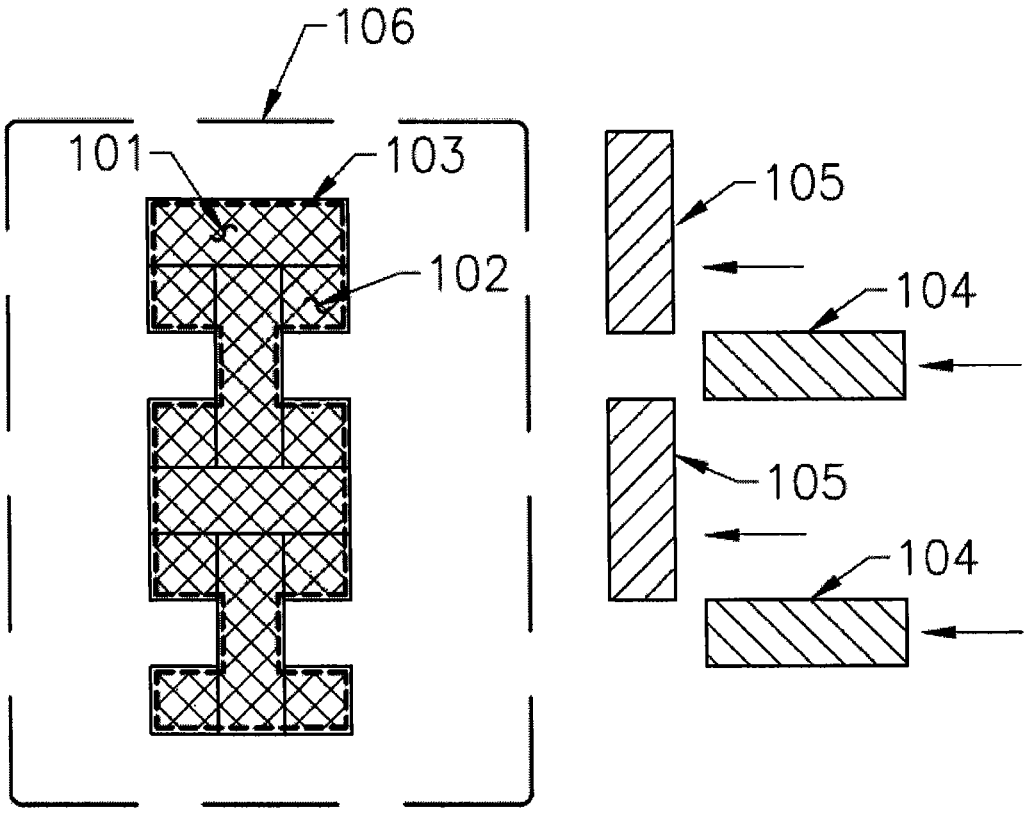
FIG. 7 is a schematic of a single board basket weave configuration mosaic parquet pattern.

GLOSSARY OF SYMBOLS (LEGEND OF NUMERICAL SYMBOLS):

1: 2× wall wood studs (below /underneath floor joist)
2: 2× wall wood studs (above floor joist)
3: 2× floor wood joists
4: 2× double top plate, nailed together
5: Shear wall sheathing and nailing
6: Shear transfer connector
7: 2× or 3× blocking between the floor joists
8: 2× or 3× base plate
9: Shear wall diaphragm edge nailing
10: Shear transfer metal connector
11: Horizontal structural plywood sheathing or plywood subfloor
12: Exterior stucco
13: Exterior building paper and wire mesh
14: Interior drywall sheathing
15: Wall thermo insulation between the studs
16: Floor thermo insulation between the joists
17: Floor special multi-purpose fire and sound proof insulation between the floor joists;
18: Flooring, not a part of structural system of the building
19: Four-way interlocking end grain mosaic parquet floor system as part of the proposed composite membrane of horizontal diaphragm of a structure;
20: $w_s$—lateral (seismic or wind) diaphragm force acting horizontally
21: Deflected shape (exaggerated) of the diaphragm membrane
22: Edge spacing between plywood panels
23: Interior drywall ceiling sheathing (single or double sheathing);
24: Plywood sheathing fastener (connector) to floor joist below
25: Section cut through the floor system—See FIG. 21;
26: Engineered wood I-beam floor joist framing;
27: Composite flexible wood diaphragm membrane
28: Web stiffener at each bearing
29: 2× or 3× blocking (engineered wood)
#30: Section cut through the floor system—see FIG. 24
#31: Centerline of plywood sheathing fastener
#32: Centerline of edge spacing between plywood panels
33: Thickness of fastener
#34: Distance from the centerline of the wood fastener to the edge of the floor joist.
#35: Distance from the centerline of the wood fastener to the edge of the plywood.
#36: Width of the floor joist
#37: Distance from edge of fastener to the edge of plywood
#38: Distance from the centerline of the wood fastener to the edge of the engineered wood floor joist
#39: Distance from the centerline of the wood fastener to the edge of the plywood
#40: Width of flange of engineered floor joist
#41: Reaction force at double plate level
#42: Section cut through the floor system—see FIG. 5A or 5C (Similar).
#46: Floor multi-purpose fire and sound proof insulation
#49: Force component acing in a direction perpendicular to the direction of lateral (seismic or wind) diaphragm force
#50: Crack or split development within the wood joist or the engineered wood joist
101: Long board of parquet
102: Small board of parquet
103: Tape to assemble parquet panel
104: Transverse board
105: Insert board
106: Single board basket weave panel
107: Thickness of parquet component
108: Adhesive, applied between components of parquet panel
109: Two position table for application of adhesive between components of parquet panel
110: Adhesive to install parquet over subfloor
111 Space between two panels of parquet in the beginning of the installation
112: Tape to cover unprotected areas of installed parquet floor
113: Double board basket weave panel
114: Double board transverse subunit
115: Double board longitudinal subunit
116: Section cut through here—refer to FIG. 9B for section view
117: Section cut through here—refer to FIG. 15B for section view FIGS. 7 to 12 show a parquet configuration for a hardwood floor that has boards arranged in a designated pattern to form an interlocking single unit. In a first preferred embodiment, FIG. 7 illustrates a board pattern referred to herein as a "Single Board Basket Weave" which is used to overlay on top of a plywood subfloor. Single board basket weave comprises modules of four long rectangular shaped boards with a typical proportion of about 1:3 and measurements of, for example, about 3 inches by 9 inches and four small square boards of about 3 inches by 3 inches. A panel of single board basket weave can consist of two, three, four, or more modules, assembled in one panel.

A preferred panel 106 of single board basket weave comprises at least two modules. In FIG. 7, each panel 106 of single board basket weave comprises four long boards 101 arranged in an end-to-end "T-shaped configuration, e.g., a series of boards arranged longitudinally, interrupted by transverse boards which are bisected by the longitudinal boards, where this pattern is repeated. There are also eight small boards 102 that are placed at the four corners of the intersection between the longitudinal and transverse boards. These twelve boards form the panel 106 as shown in FIG. 7. To interlock this panel with another panel, longitudinal boards 105 are placed at the small board, large board, small board interface, with transverse boards 104 placed in the boards between the small boards. Then a new panel is placed up against the transverse boards 104, and the pattern is repeated. All components are preferably made from heat treated Douglas fir lumber with surfaces of all components of the design in end grain cut, and, therefore, all sides of those components are edge grained. All components have straight edges. Once assembled, the panel 106 may be preferably held together with transparent plastic tape 103 with a pressure sensitive adhesive applied on one side. The adhesive side of the tape is installed on the top of the panel, holding all components together.

Figure 8A:
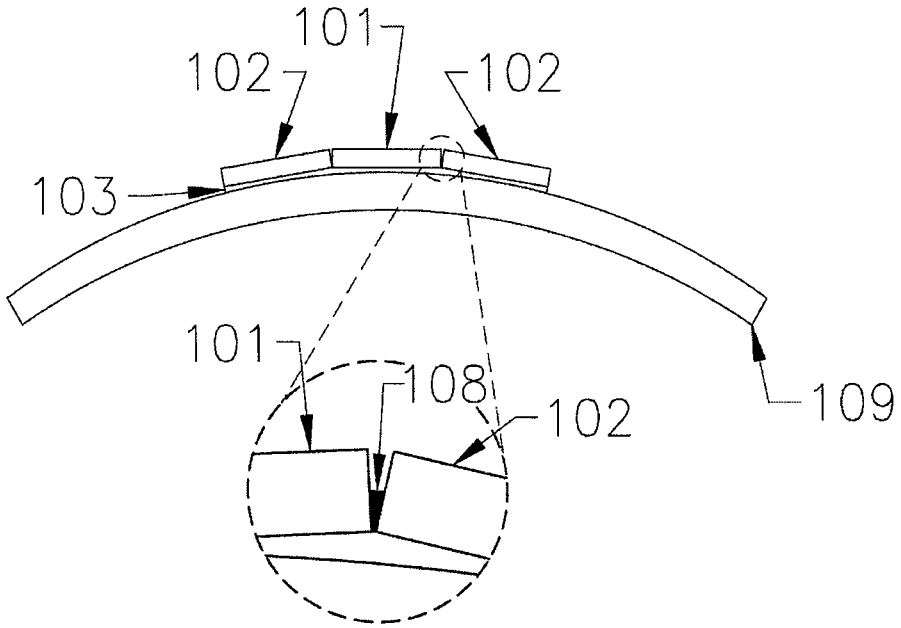
FIG. 8A is a cross sectional view, partially enlarged, illustrating an application of adhesive between components of a panel.

FIG. 8A shows an application of adhesive between each component of a panel 106. To form a panel of this type, a panel 106 is turned upside down and placed over a two position table top 109 having a linear position and an arced position. The surface of the table includes a sheet of adhesive tape 103. The table top 109 is set in the arced position (FIG. 8A) so that all edges of the components of the panel are opened in a V-shaped position (see inset, FIG. 8A), where adhesive 108 is placed between the elements by an applicator (not shown). This adhesive 108 should have a medium level of viscosity and stay in such condition preferably between forty five to ninety minutes. After curing, the adhesive becomes rigid and, at the same time, still has a sufficient degree of elasticity within the glue joints. Adhesive 108 may be preferably colored to match the color of the selected wood after parquet flooring finishing.

Figure 8B:
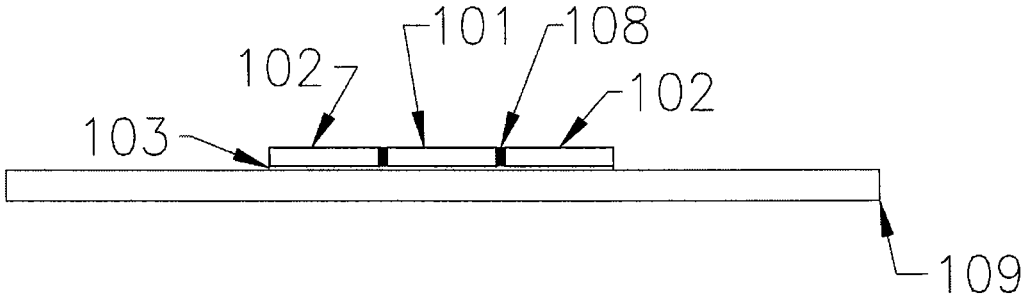
FIG. 8B is a cross sectional view of the panels of FIG. 8A after an application of the adhesive.

FIG. 8B shows the panel 106 after the table top 109 has been moved to the flat position, such that when the top portions of the adjacent boards are brought into proximity with each other, the V-shaped gap is reduced and the adhesive 108 fills the entire space between the components of the panel.

Figure 9A:
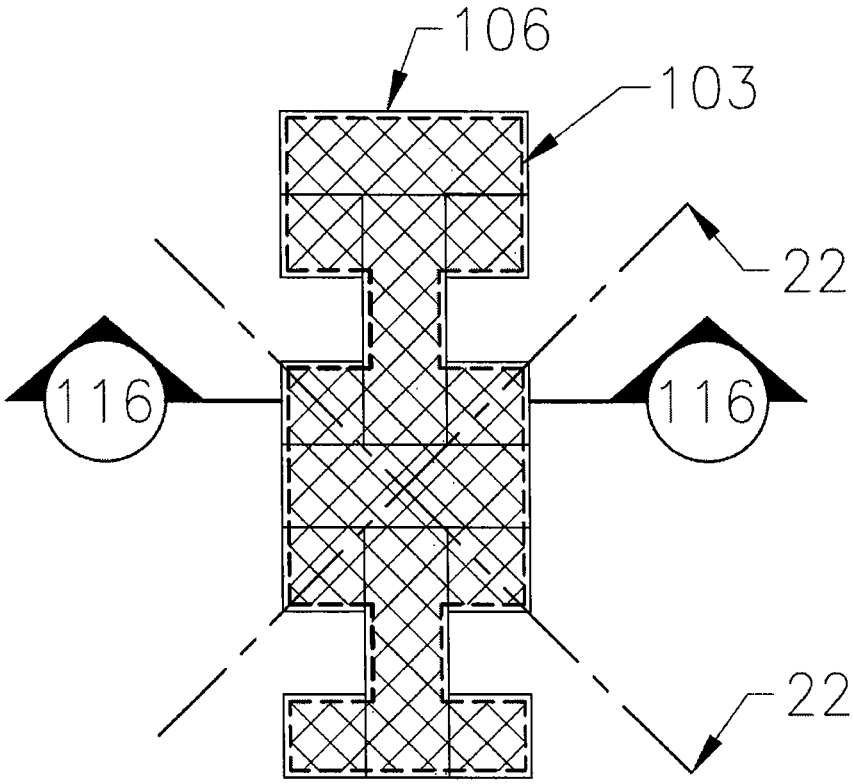
FIG. 9A is a schematic view of a single board basket weave configuration.

FIG. 9A shows an installation of a first panel of a single board basket weave 106 over a plywood subfloor. In a preferred embodiment, the panel 106 is placed diagonal (at a 45° angle) to the joints 22 of plywood underneath. In this manner, the exposed joints or edges of the plywood is covered by multiple panels, creating additional security and reinforcement in the overlaying panels.

Figure 9B:
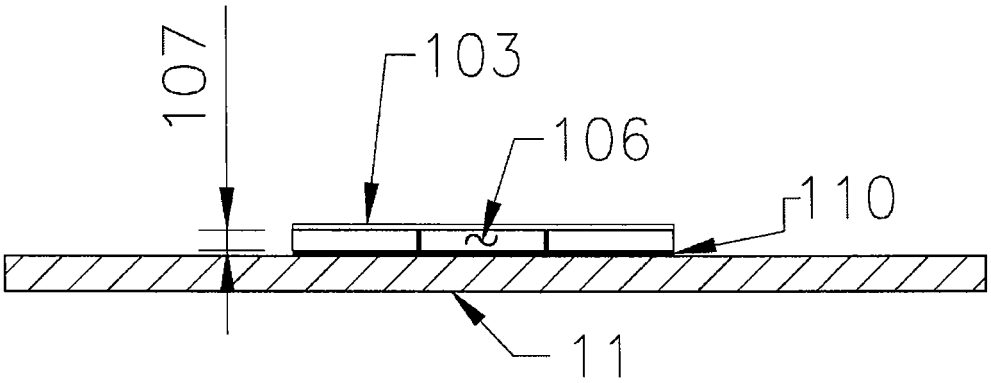
FIG. 9B is a cross-section view of a panel installed over plywood subfloor.

FIG. 9B shows a cross-section 116 of the panel and subfloor of FIG. 9A. A preferred thickness of all boards 107 is 0.53 inches, which becomes 0.50 inches after sanding. The cross sectional view shows a single board basket weave parquet panel 106 installed over plywood 11 by placing it into adhesive 110 applied on the surface of the plywood. This adhesive becomes rigid after curing and provides a high strength bond between the parquet 106 and the plywood 11. Adhesive 110, same as adhesive 108, may be colored to match the color of the boards after parquet flooring finishing.

Figure 9C:
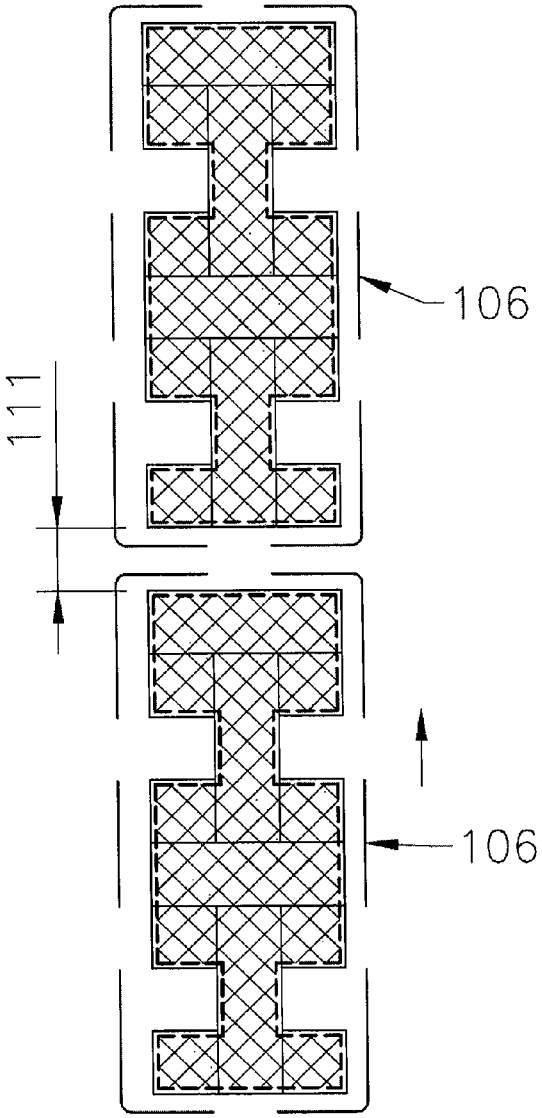
FIG. 9C and FIG. 9D illustrate installation of a single board basket weave configuration.

FIG. 9C shows an installation of a second single board basket weave panel 106 over plywood. The second panel is placed within a distance 111 of about 1 inch from the first panel.

Figure 9D:
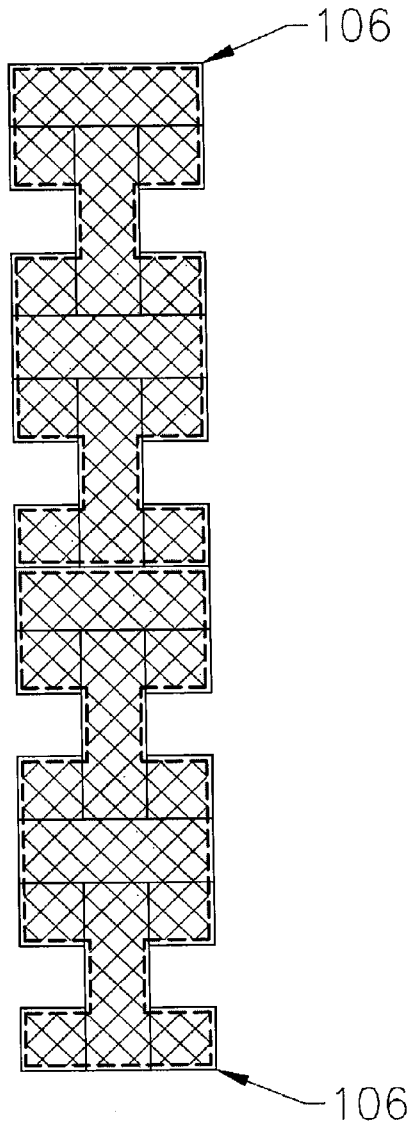

FIG. 9D shows the first two panels of the single board basket weave 106 in their final, installed position. As the panels are pushed along the plywood, adhesive moves up and fills the spaces between the panels, wetting the vertical edges to provide an even stronger bond after its curing.

Figure 10:
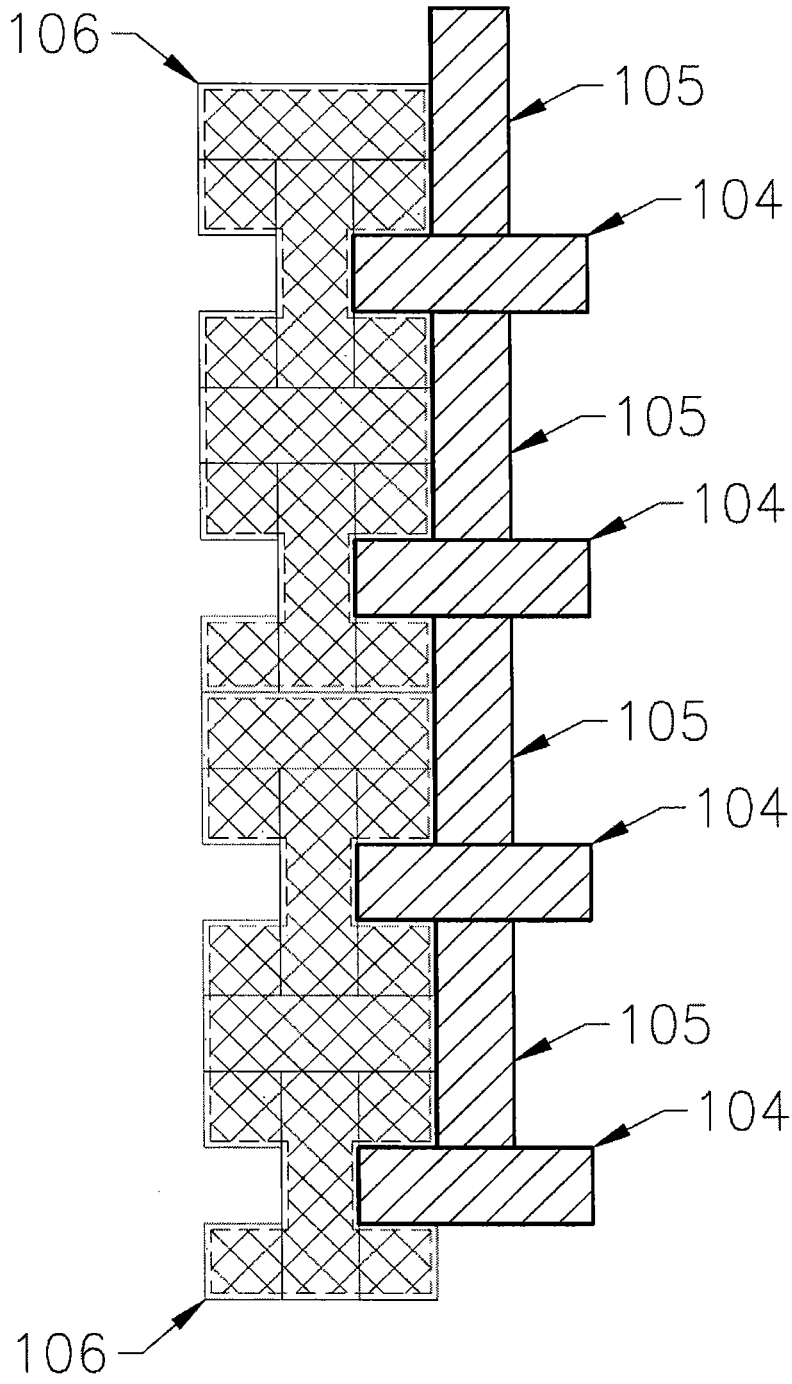
FIG. 10 is a schematic view of an installation of transverse and longitudinal boards on the side of a first row of parquet panels in a single board basket weave configuration.

FIG. 10 shows an installation of a set of transverse boards 104 and longitudinal boards 105 on the side of a first row of installed single board basket weave parquet by placing the boards in adhesive on the plywood about 1 inch from their final position and slid into place, providing a movement up of the adhesive 110 on the vertical edges.

Figure 11:
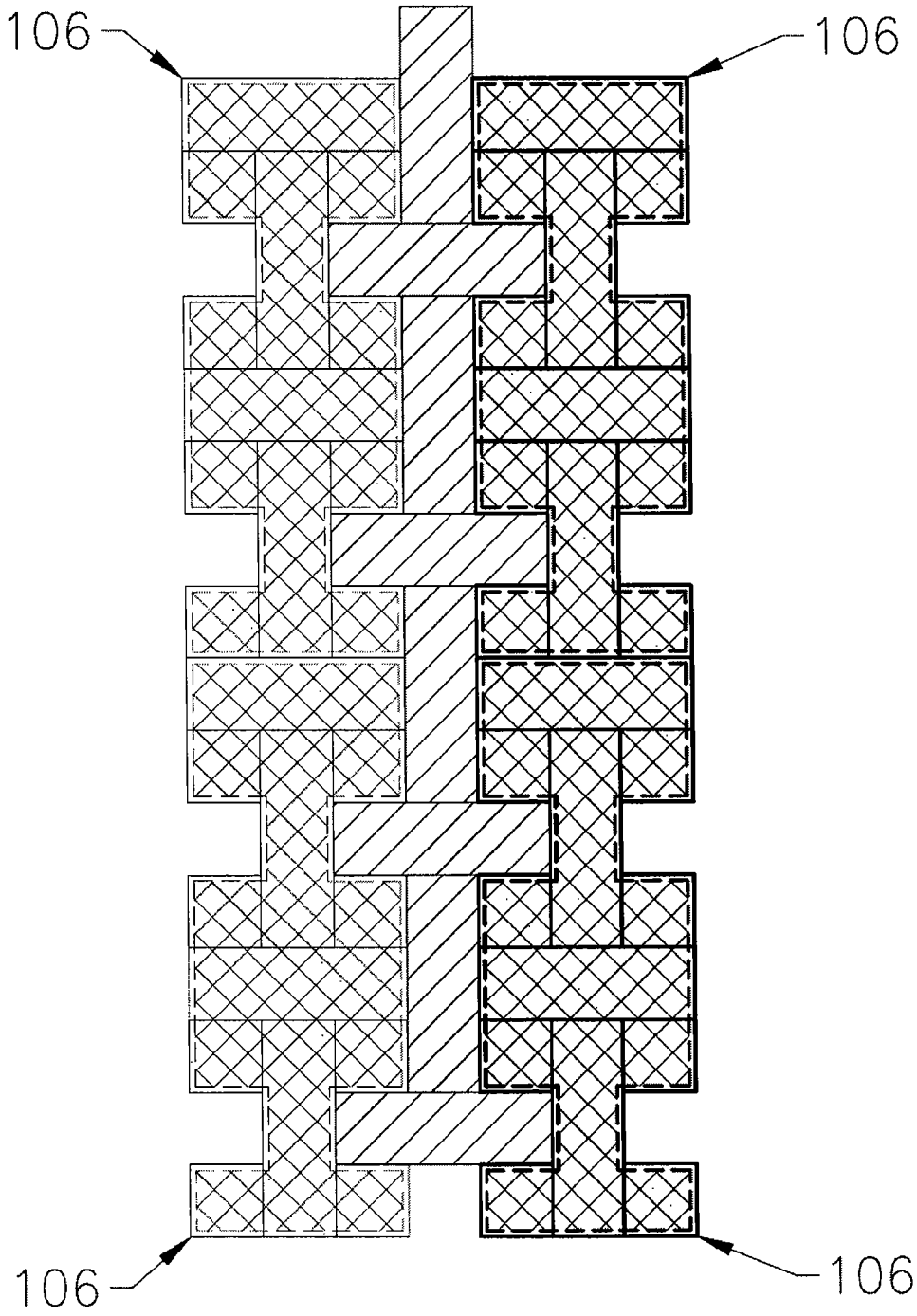
FIG. 11 is a schematic view of an installation of a second row of panels in a single board basket weave configuration.

FIG. 11 shows an installation of a second row of panels 106 over plywood. At first, one panel 106 is placed over adhesive about 1 inch outside of its final position and moved into position by sliding it horizontally. Then the second panel 106 is placed over the adhesive 110 about 1 inch outside of its final position and moved into position by sliding it horizontally. During such installation adhesive 110 moves up the side of the parquet, filling all the edges of the joints between the panels.

Figure 12:
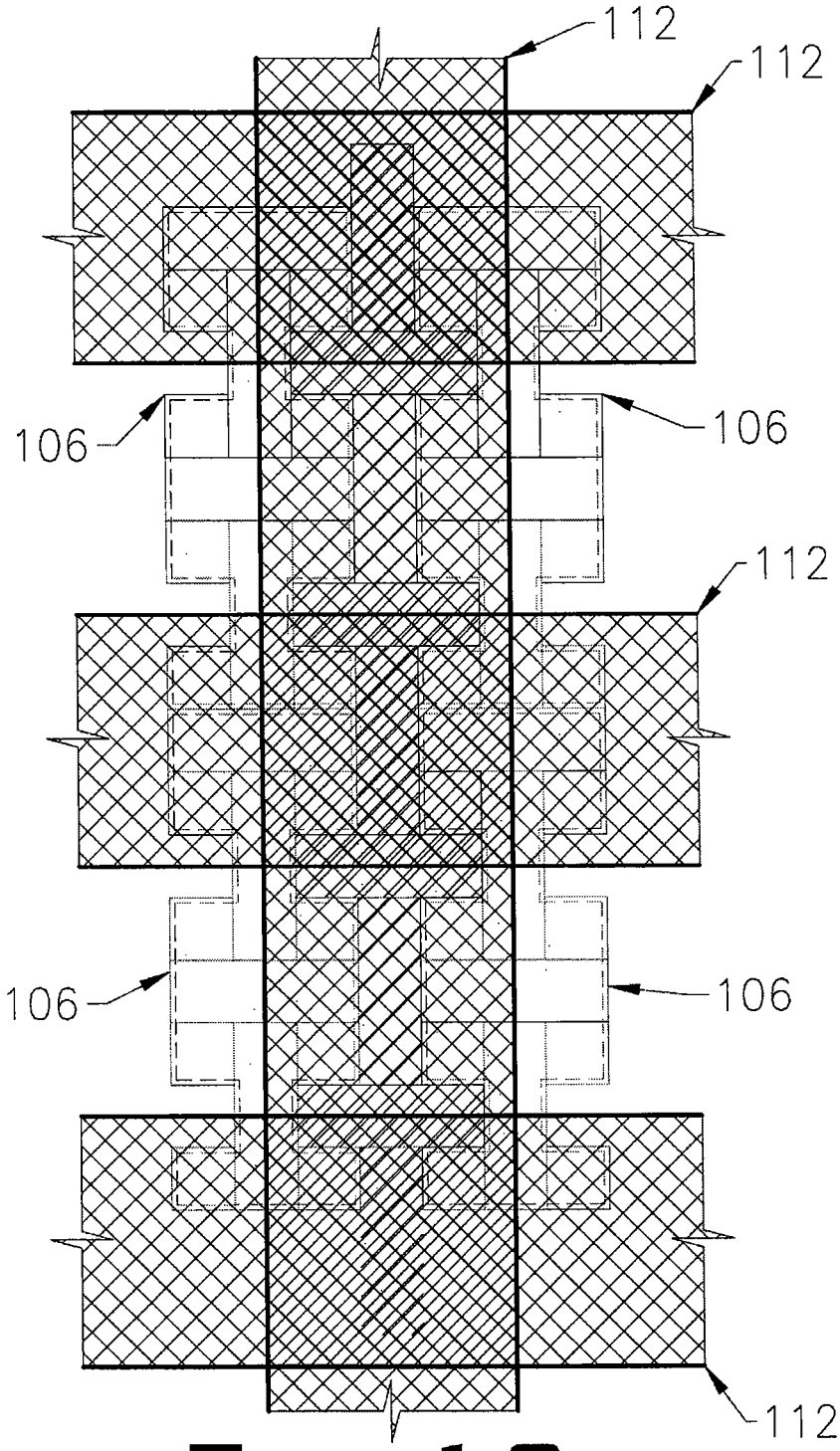
FIG. 12 illustrates an application of a tape over unprotected areas of parquet flooring.

FIG. 12 shows an application of tape 112 over unprotected areas of installed parquet flooring. Tape 112 is similar to tape 103 and placed over the parquet by putting its adhesive applied surface on the top of the installed parquet. Width 111 of such tape may be about 3 inches wider than the width of long board 101 of the parquet.

FIG. 13-18 show a double board basket weave design and method of its installation over a plywood subfloor. Both single board basket weave and double board basket weave are made from the same materials, treated in the same fashion, produced, assembled, and installed in the same way. The primary difference between these designs is that the transverse boards and longitudinal boards in the double board basket weave are produced and installed as small subunits, consisting of two boards assembled with tape.

Figure 13:
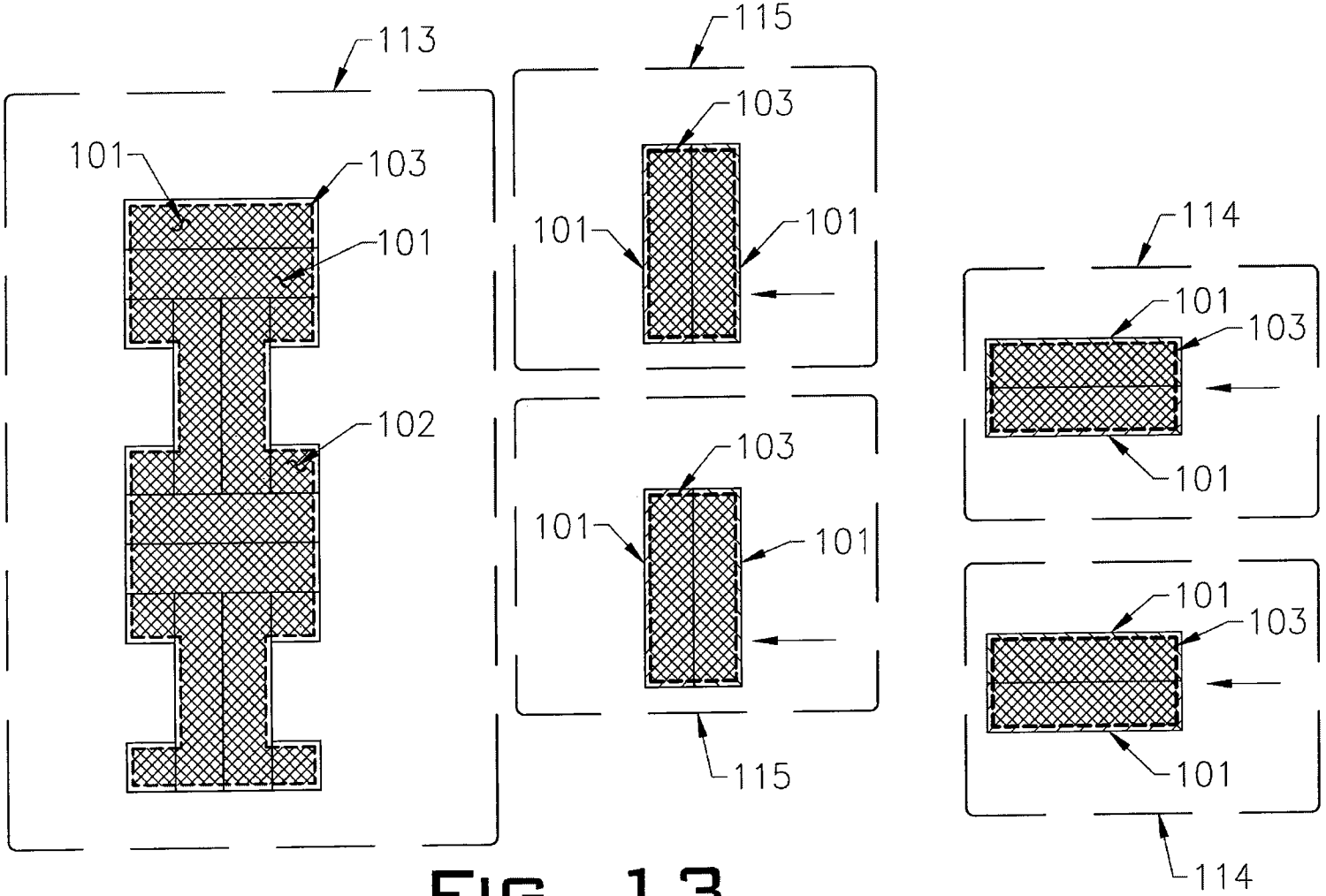
FIG. 13 is a schematic view of a double board basket weave configuration.

FIG. 13 shows a panel of double board basket weave 113, consisting of eight long boards 101 and eight small boards 102, where long board 101 is of rectangular shape and preferably made in the proportion of about 1:4 with measurements about 3 inches by 12 inches or 2¼ inches by 9 inches. Small board 102 is preferably square with sizes accordingly about 3 inches by 3 inches or 2¼ inches by 2¼ inches. A panel 113 is assembled with transparent plastic tape 103 with a pressure sensitive adhesive applied on one side. The adhesive side of the tape is installed on the top of the panel, holding all components together. Additionally, a panel of double board basket weave parquet has two sets of double transverse locking boards 114 and two sets of double longitudinal boards 115.

Figure 14A:
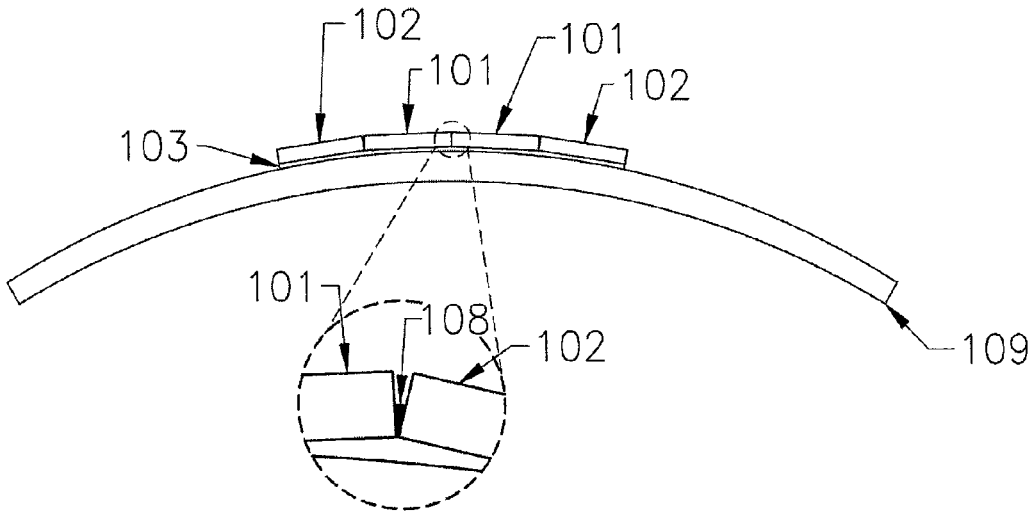
FIG. 14A is a cross sectional view, partially enlarged, illustrating an application of adhesive between components of a panel.

FIG. 14A shows adhesive between each component of a panel of double board basket weave 113. The panel 113 is turned upside down and placed over a two position table top 109, with the tape 103 installed on the bottom. A table top 109 is set in an arced position such that all edges of the components of the panel are opened in a v-shaped position, where adhesive 108 is placed by an applicator (not shown). This adhesive has a medium level of viscosity and stays in such condition between forty five to ninety minutes. After curing, the adhesive will become rigid and, at the same time, still have a sufficient degree of elasticity within the glue joints.

Figure 14B:
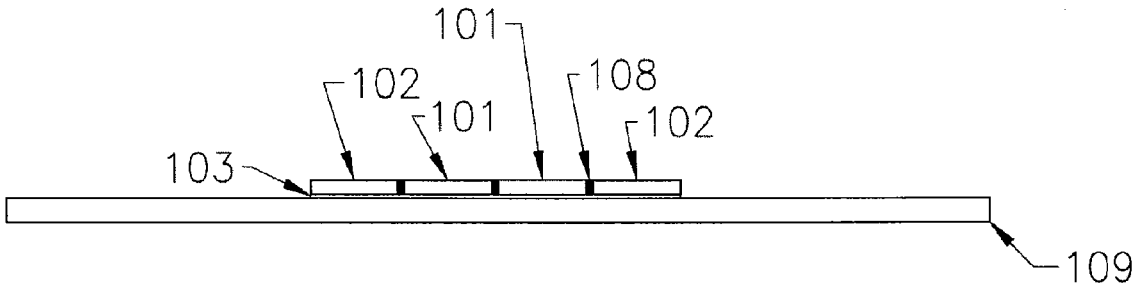
FIG. 14B is a cross sectional view of the panels of FIG. 8A after an application of the adhesive.

FIG. 14B shows a double board basket weave panel 113 in closed/flat position on the table, where adhesive 108 fills the entire space between the components of the panel.

Figure 15A:
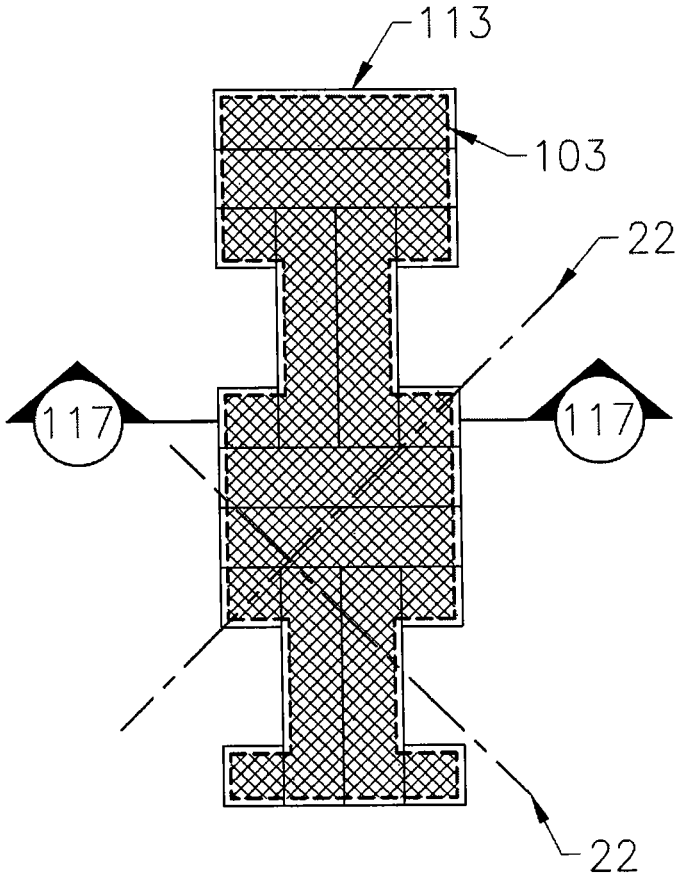
FIG. 15A is a schematic view of a double board basket weave configuration.

FIG. 15A shows an installation a double board basket weave panel 113 over a plywood subfloor. The panel is preferably placed diagonally (on 45 degree angle) with respect to the joints 22 of plywood underneath.

Figure 15B:
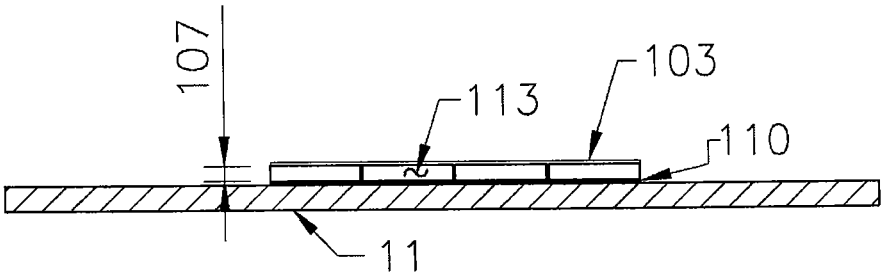
FIG. 15B illustrates a cross-section view of a panel installed over plywood subfloor.

FIG. 15B shows a cross-section 117 of FIG. 15A. A thickness of all of the components 107 is roughly 0.53 inches, which will become 0.50 inches after sanding. A double board basket weave parquet panel 113 is installed over the plywood 11 by placing it into adhesive 110 applied on the surface of the plywood. This adhesive becomes rigid after curing and provides a high strength bond between the parquet and the plywood. Adhesive 110, same as adhesive 108, may be colored to match the color of the selected wood of the parquet after the parquet flooring's finishing.

Figure 15C:
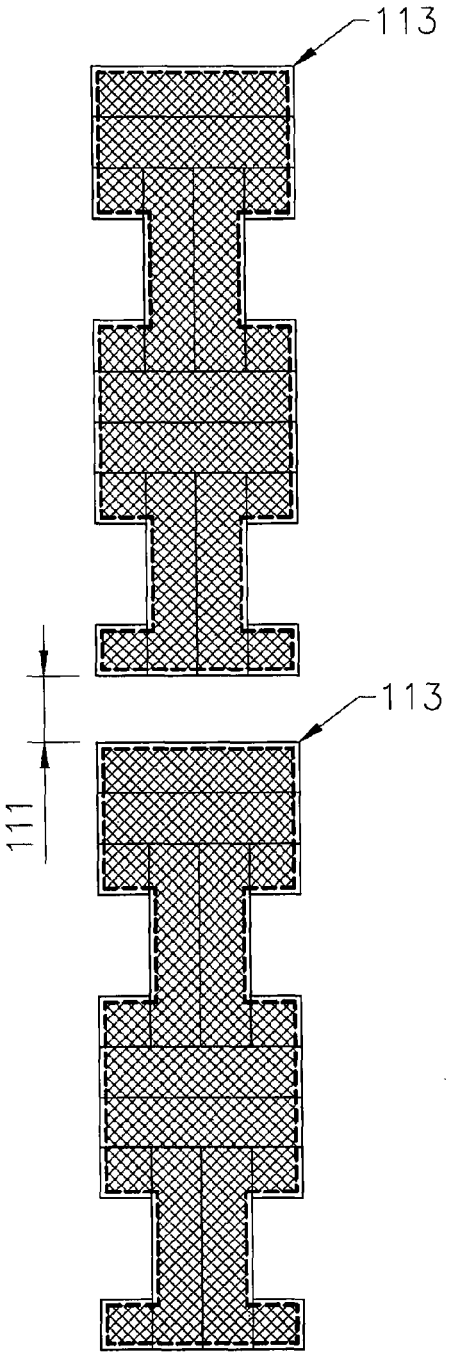
FIG. 15C and FIG. 15D illustrate an installation of a double board basket weave configuration.

FIG. 15C shows an installation of a second double board basket weave panel 113 over a plywood subfloor. A second panel is placed at a distance 111 of about 1 inch from first panel.

Figure 15D:
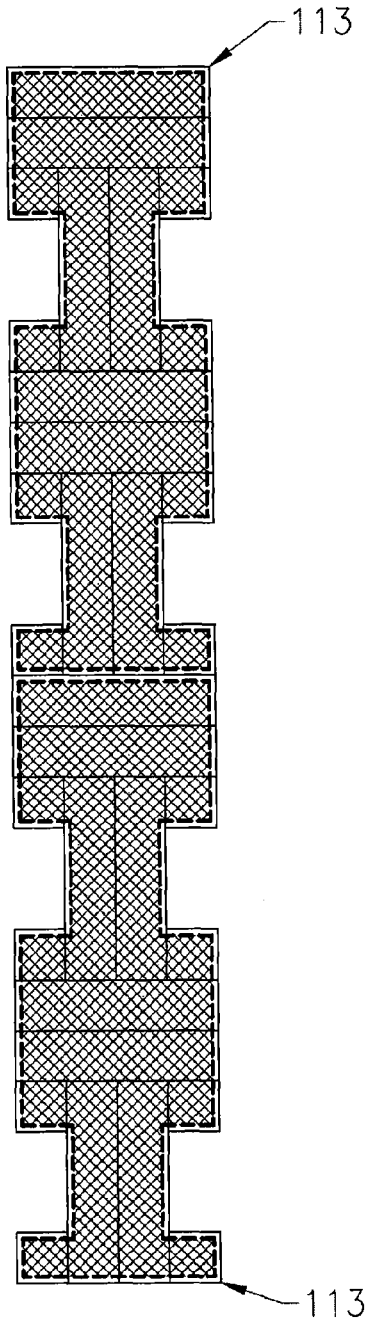

FIG. 15D shows the first two panels of a double board basket weave 113 in the final/installed position. During the movement of the panel of about 1 inch over the plywood, adhesive moves up and fills spaces between the panels, providing a strong glue bond after curing.

Figure 16:
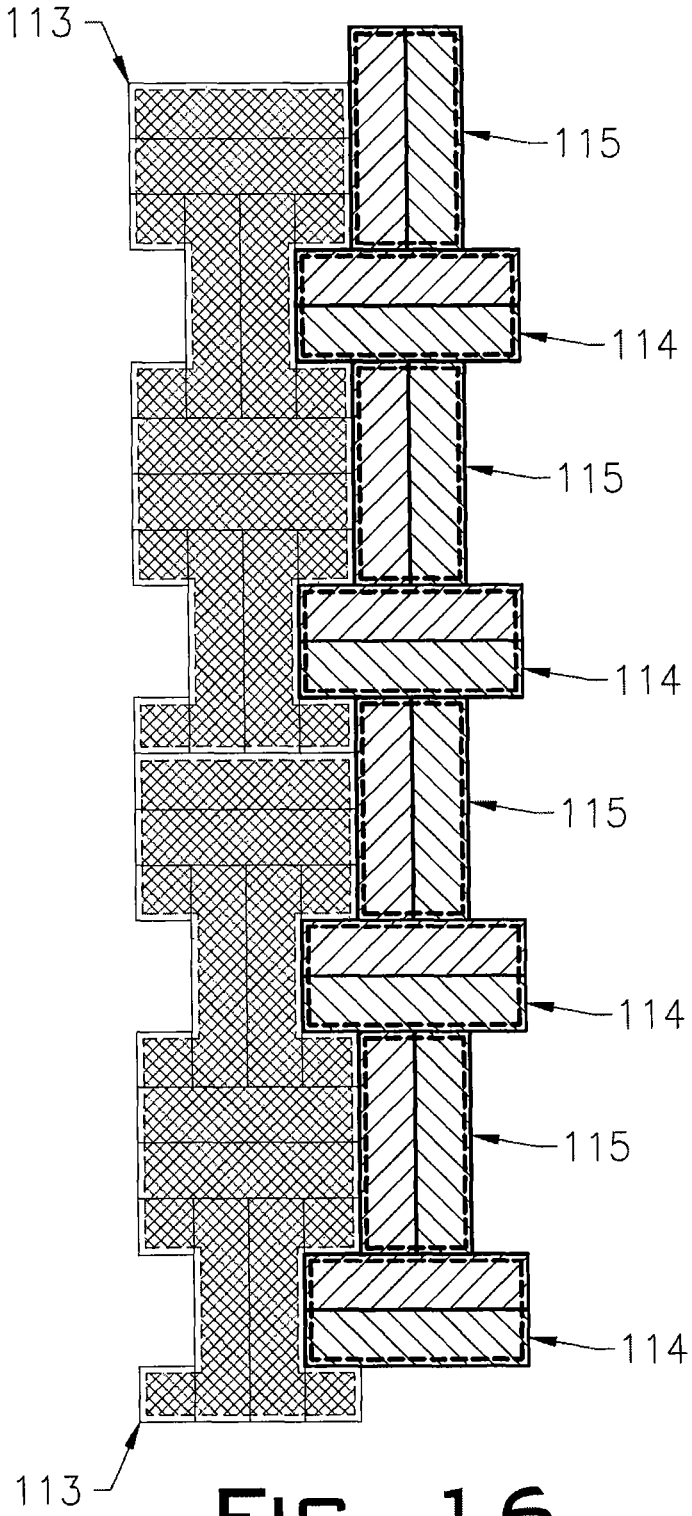
FIG. 16 is a schematic view of an installation of double board insert panels and double board locking panels on the side of a first row of parquet panels in a double board basket weave configuration.

FIG. 16 shows an installation of sets of double transverse locking panels 114 and double board longitudinal panels 115 on the side of a first row of installed double board basket weave parquet by placing the boards in adhesive and applied on the plywood about 1 inch from their final position and slid together, providing a movement up of the adhesive 110 on all edges to provide a structurally strong glue bond after its curing.

Figure 17:
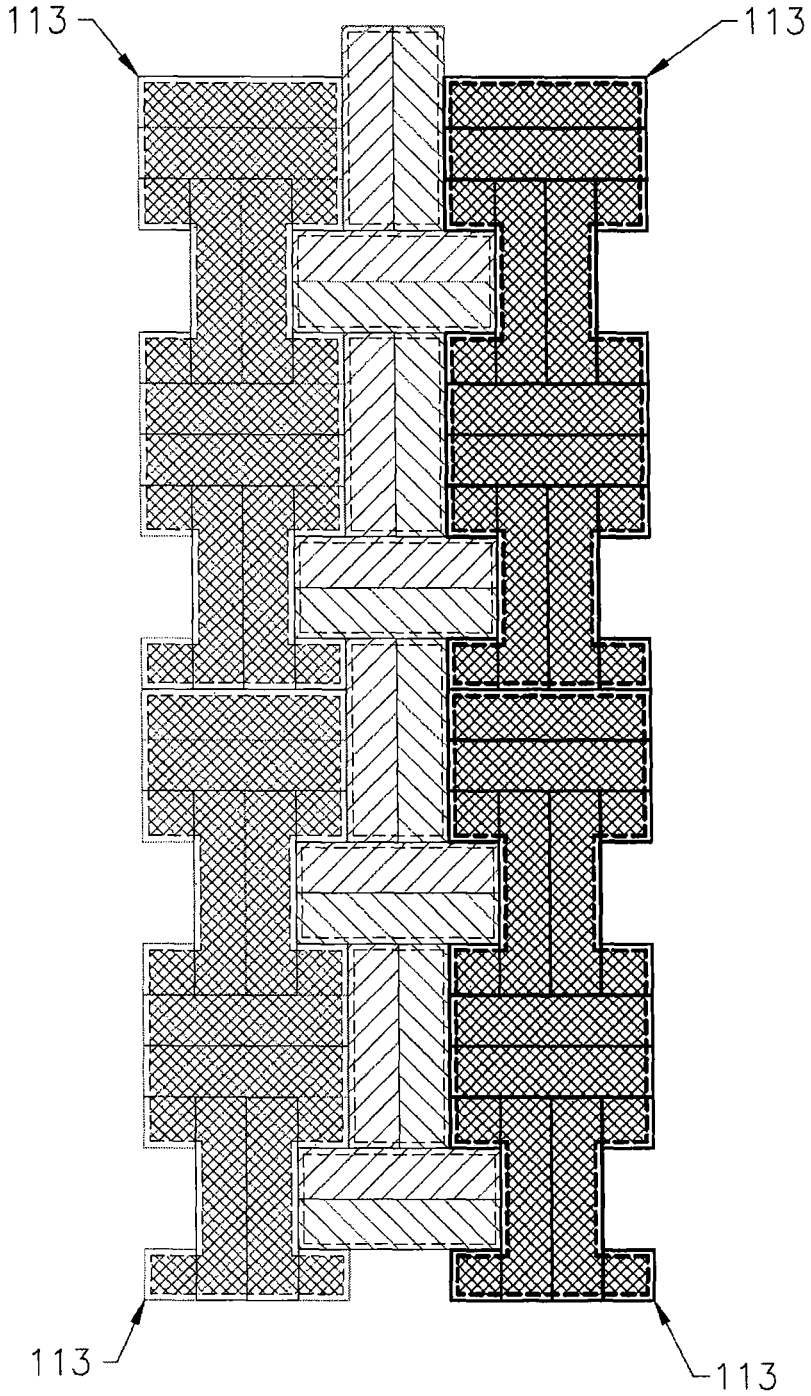
FIG. 17 is a schematic view of an installation of a second row of panels to the configuration of FIG. 16.

FIG. 17 shows an installation of a second row of panels 113 over plywood. At first, one panel 113 is placed over the adhesive about 1 inch outside of final position and moved in final position by sliding it horizontally. Then the second panel 113 is placed over adhesive 110 about 1" outside of its final position and moved into its final position by sliding it horizontally. During such installation adhesive 110 moves up the side of the parquet, filling all the edges of the joints between the panels, providing a structurally strong glue bond after its curing.

Figure 18:
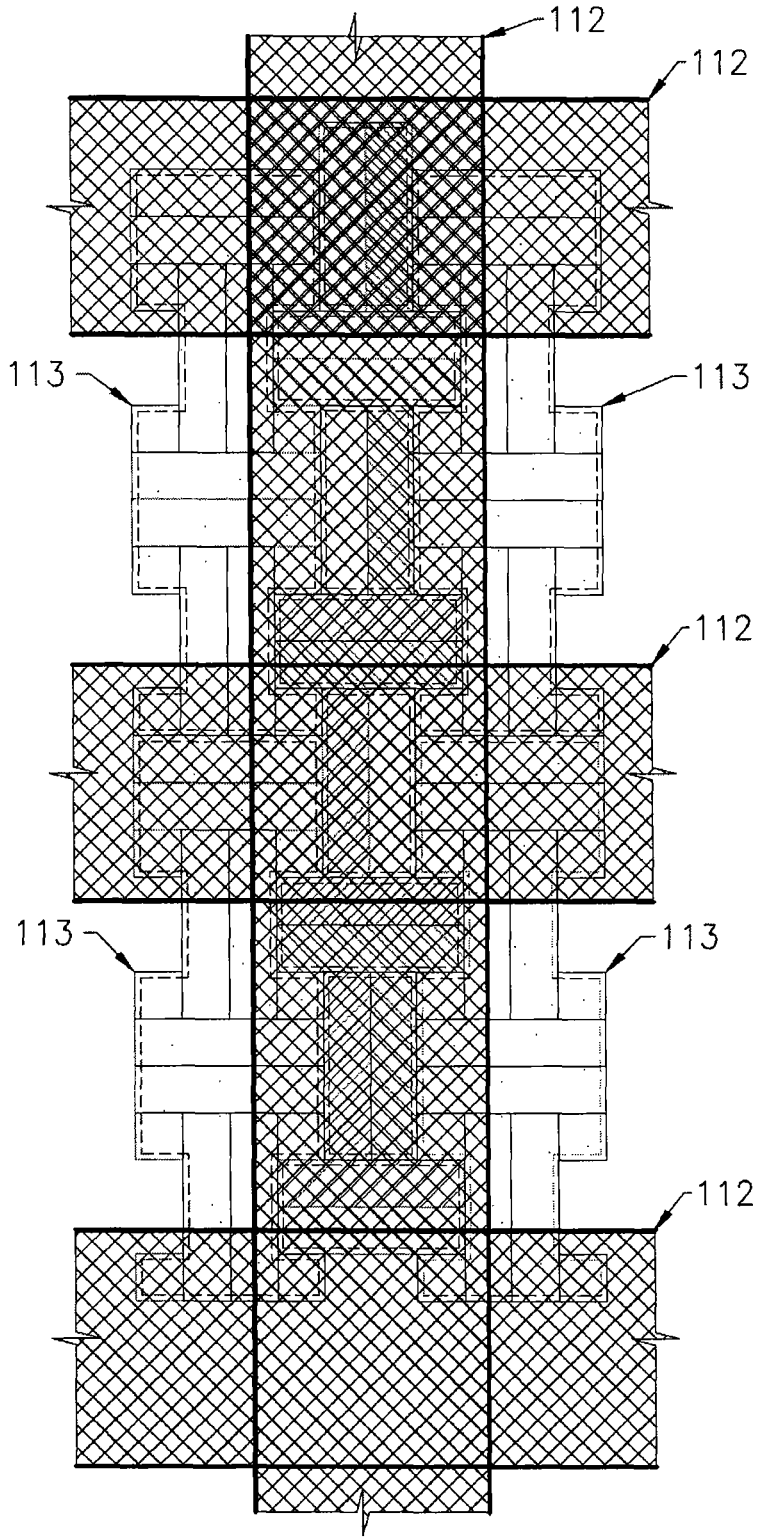
FIG. 18 illustrates an application of a tape over unprotected areas of parquet flooring.
Figure 20:
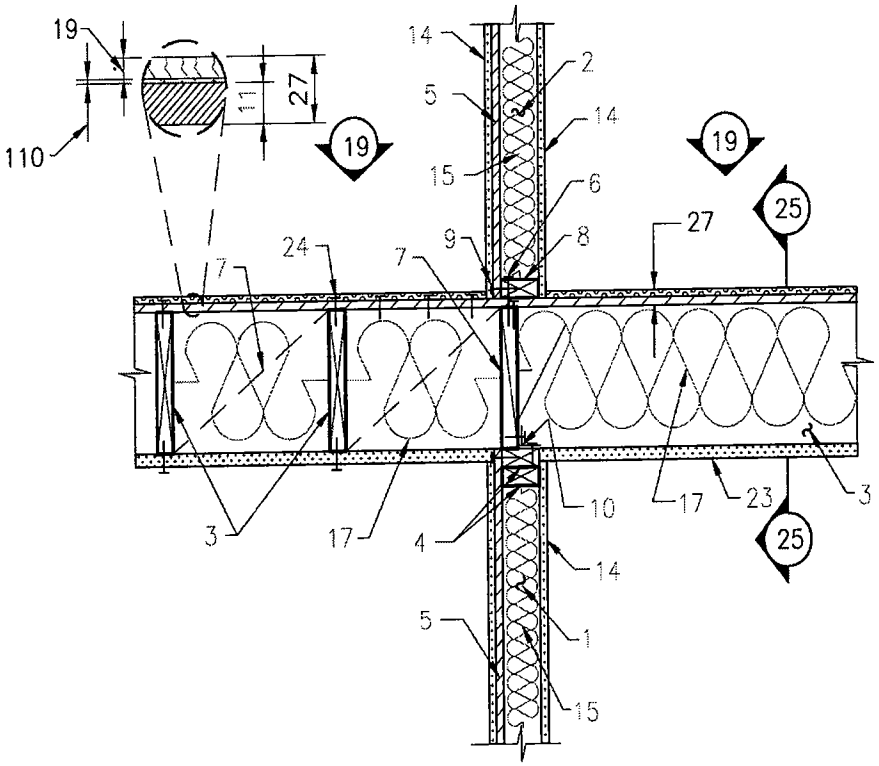
FIG. 20 is a cross-sectional view at floor level of a wood frame building through the interior bearing shear wall.
Figure 19:
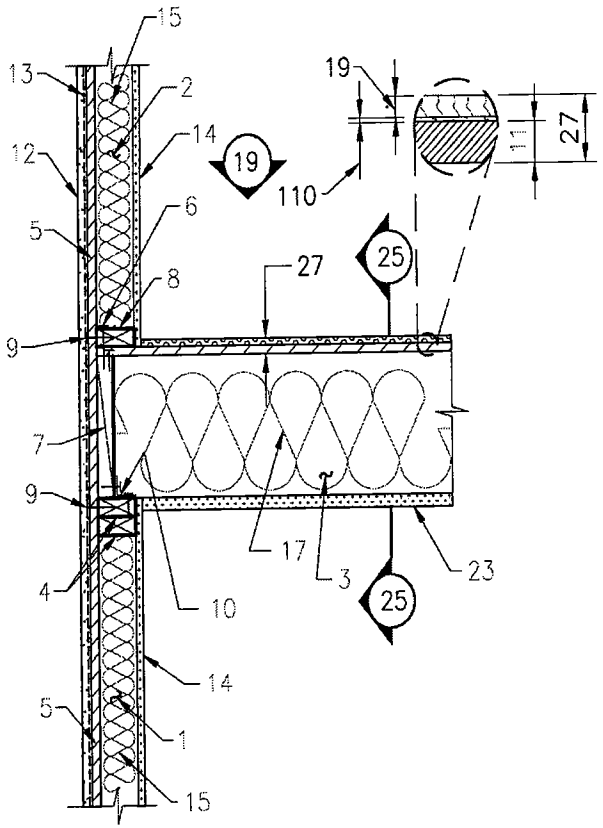
FIG. 19 is a cross-sectional view at floor level of a wood frame building through the exterior bearing shear wall.

FIG. 18 shows an application of tape 112 over the unprotected areas of installed parquet flooring. Tape 112 is similar to tape 103 and placed over the parquet by putting its adhesive applied surface on the top of the installed parquet. A width 111 of such tape preferably is about 3 inches wider than a width of long board 101 of the parquet.

For FIG. 19, FIG. 20, FIG. 22 and FIG. 23, the mosaic parquet floor system 19 does not continue under the wall framing of a new or existing wood frame building. Instead of a non-structural flooring 18, as described in the Background of Invention, installed over the subfloor 11, the four-way interlocking end grain mosaic parquet floor system 19 is diagonally installed over the plywood subfloor 11 by means of a high strength adhesive 110. The aforementioned end grain mosaic parquet floor 19 diagonally installed over to the plywood subfloor 11 beneath by means of a high strength adhesive 110 achieves formation of a composite membrane of structural wood floor diaphragm 27. As a result of creating the aforementioned composite membrane of structural wood floor diaphragm 27, the flooring material 19 is positively contributes to the structural system of a new or existing wood diaphragm building by means of its participation in gravity and lateral load resistance, as well as acting as a lateral load transfer mechanism. Thereby, the flooring material is being included into the actual structural system of the new or existing wood frame building.

A bridging is created over the edge spacing 22 between plywood panels 11, holding the plywood panels 11 together and, thus, providing reinforcement of vulnerable regions within plywood subfloor. For new building construction as well as for the purposes of strengthening (rehabilitation) of the plywood panel diaphragms of the existing buildings, this bridging action provides improved resistance to forces in a direction perpendicular to the direction of in-plane lateral (seismic or wind) diaphragm force application, thus improving resistance to the initial tributary seismic or wind forces applied to the floor diaphragm.

For FIG. 25, FIG. 26, FIG. 27 and FIG. 28, a mosaic parquet floor system 19 continues under the wall framing of a new or existing wood frame buildings. Instead of non-structural flooring 18 (see Background of Invention) installed over the subfloor 11, the four-way interlocking end grain mosaic parquet floor system 19 is diagonally installed over the plywood subfloor 11 beneath by means of a high strength adhesive 110. The aforementioned end grain mosaic parquet floor 19 diagonally installed over to the plywood subfloor 11 by means of high strength adhesive 110 achieves the formation of a composite membrane of structural wood floor diaphragm 27. As a result of creating the aforementioned composite membrane of structural wood floor diaphragm 27, parquet floor 19 positively contributes to the structural system of a new or existing wood diaphragm of building by means of its participation in gravity and lateral load resistance action, as well as a lateral load transfer mechanism. Thereby, flooring material is included into the actual structural system of the new or existing wood frame building.

Figure 26:
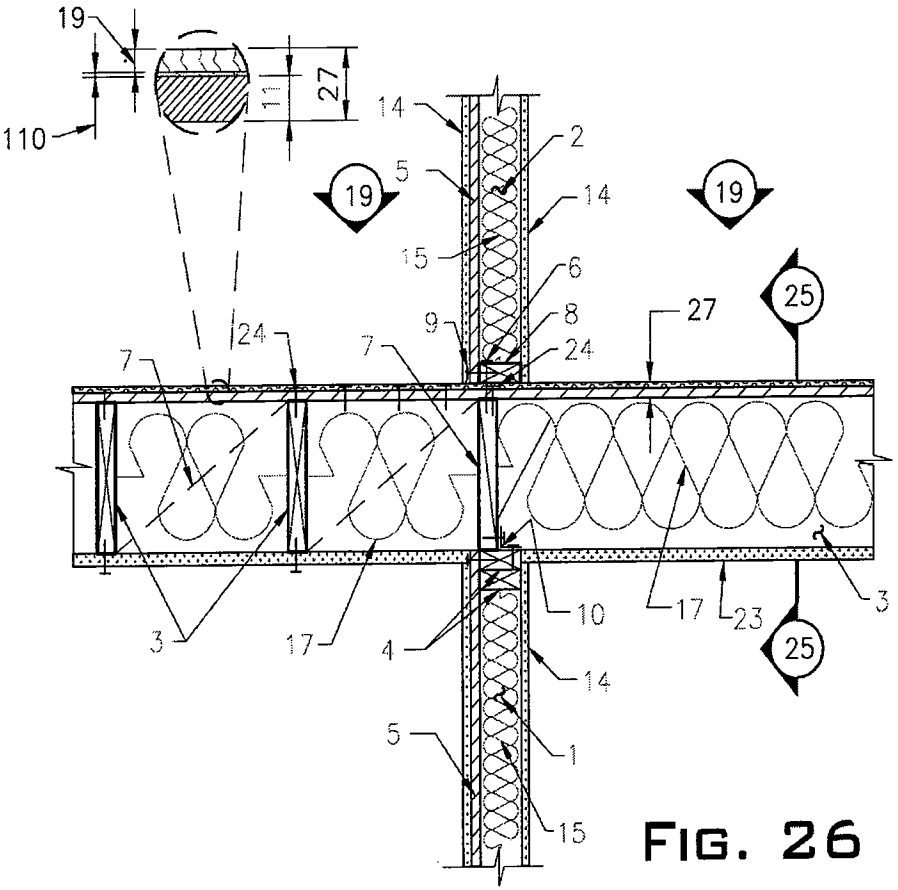
Figure 25:
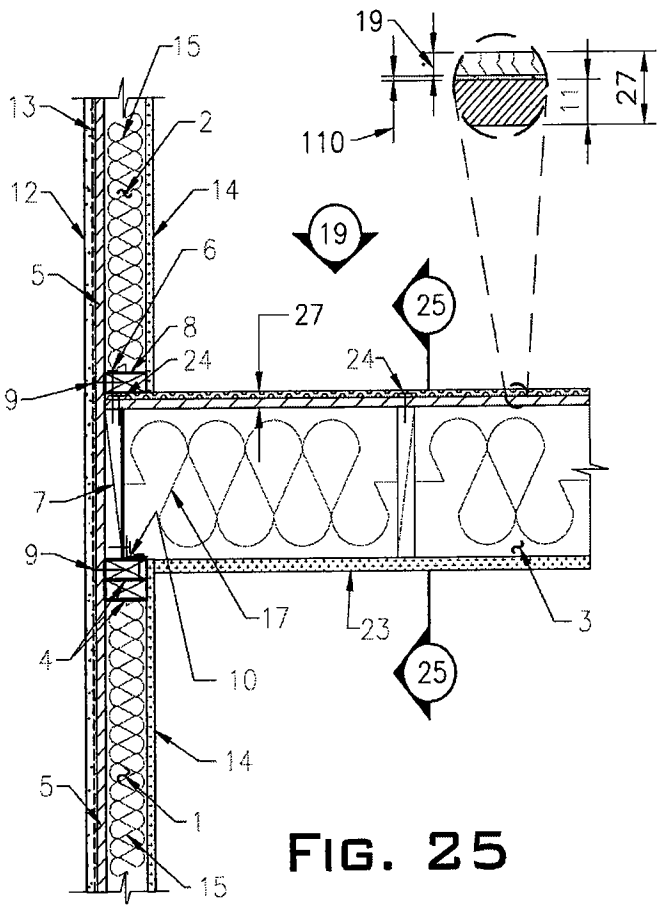
Figure 28:
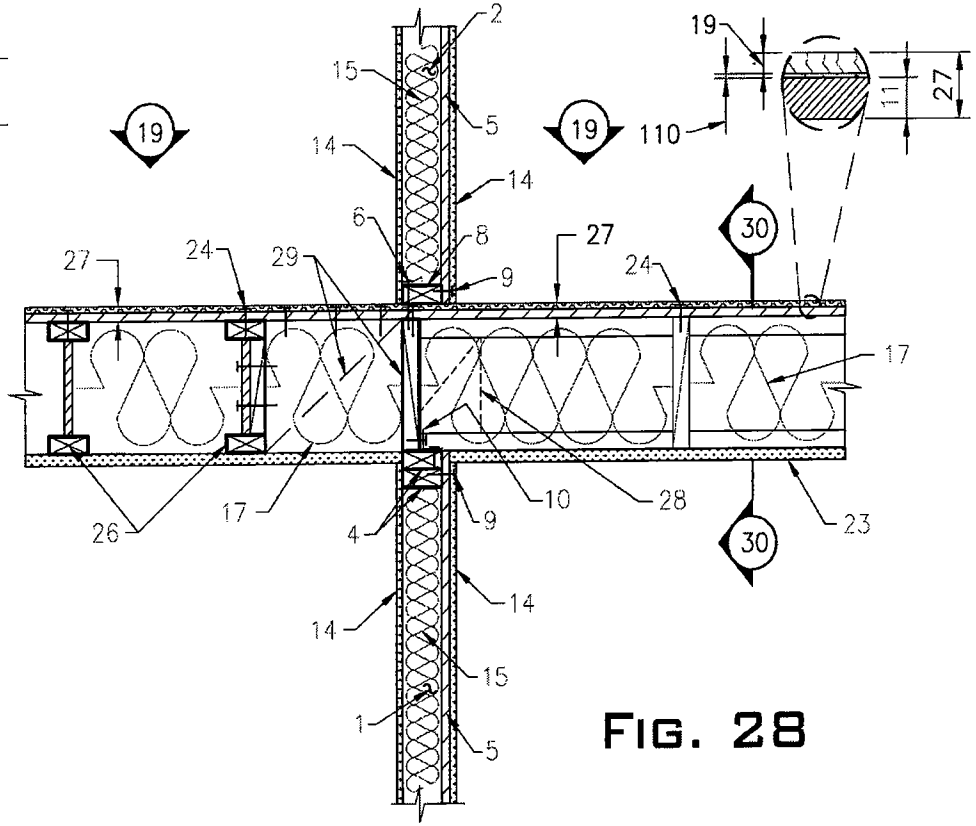
Figure 27:
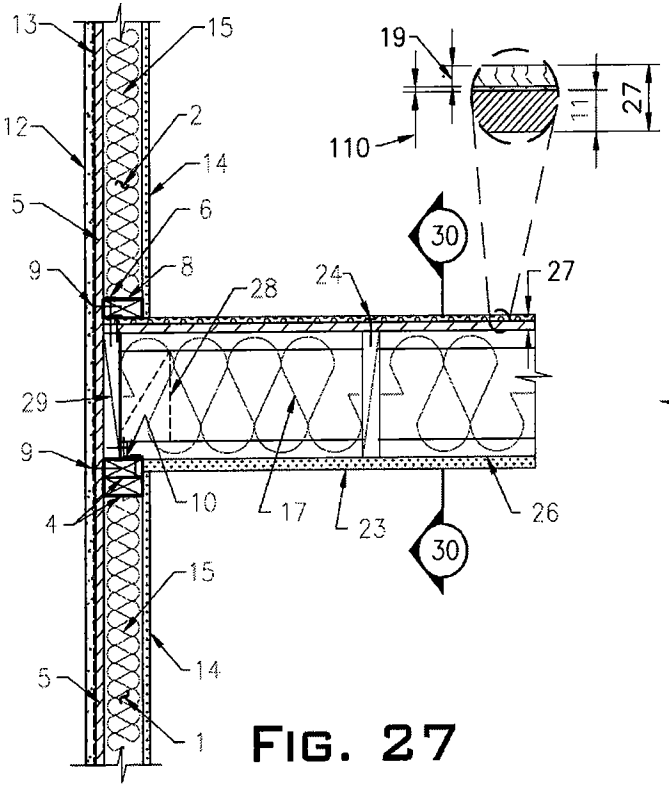

In FIG. 25, FIG. 26, FIG. 27 and FIG. 28, the flooring system 19 is installed underneath the of the succeeding wall framing, prior to the construction of the subsequent floor wall framing. In FIGS. 25 and 27, the flooring system 19 is installed all the way up to the end of base plate 8 and the end of plywood sheathing 11, since the floor system ends past that point. In FIG. 26 and FIG. 28 the flooring system 19 continues together with plywood sheeting 11 beyond the limits of the wall framing above. The succeeding (second) floor base plate 8 is installed over the composite membrane 27.

Shear transfer connectors 6 are installed all the way through the base plate 8 and the entire composite membrane of the wood diaphragm 27, while penetration into the blocking 7 on FIG. 25 and FIG. 26 and, correspondingly, through blocking 29 on FIG. 27 and FIG. 28, remains the same.

Figure 21:
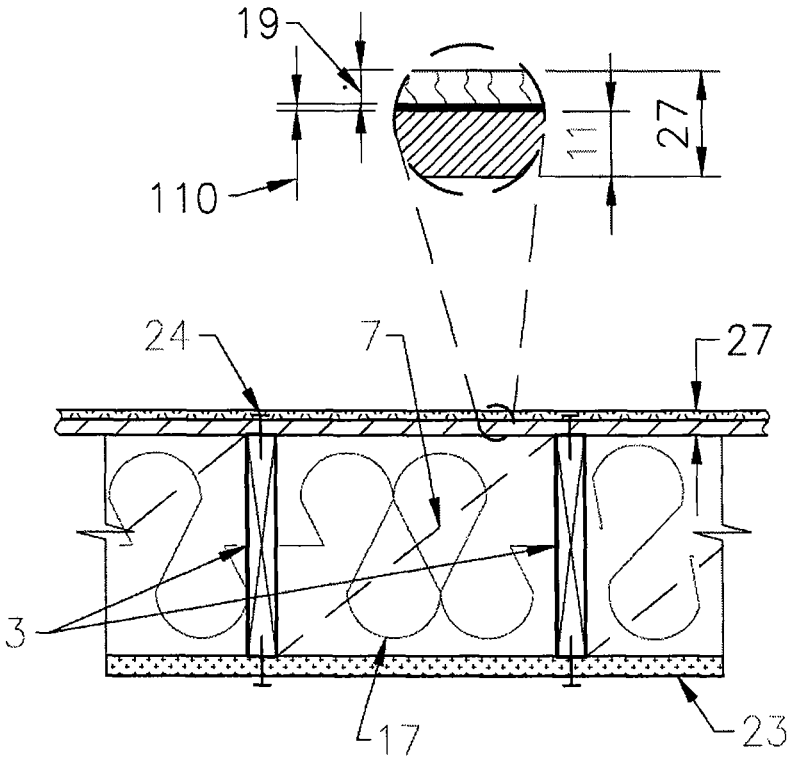
FIG. 21 is a cross-sectional view, partially enlarged, cut through the wood floor.
Figure 23:
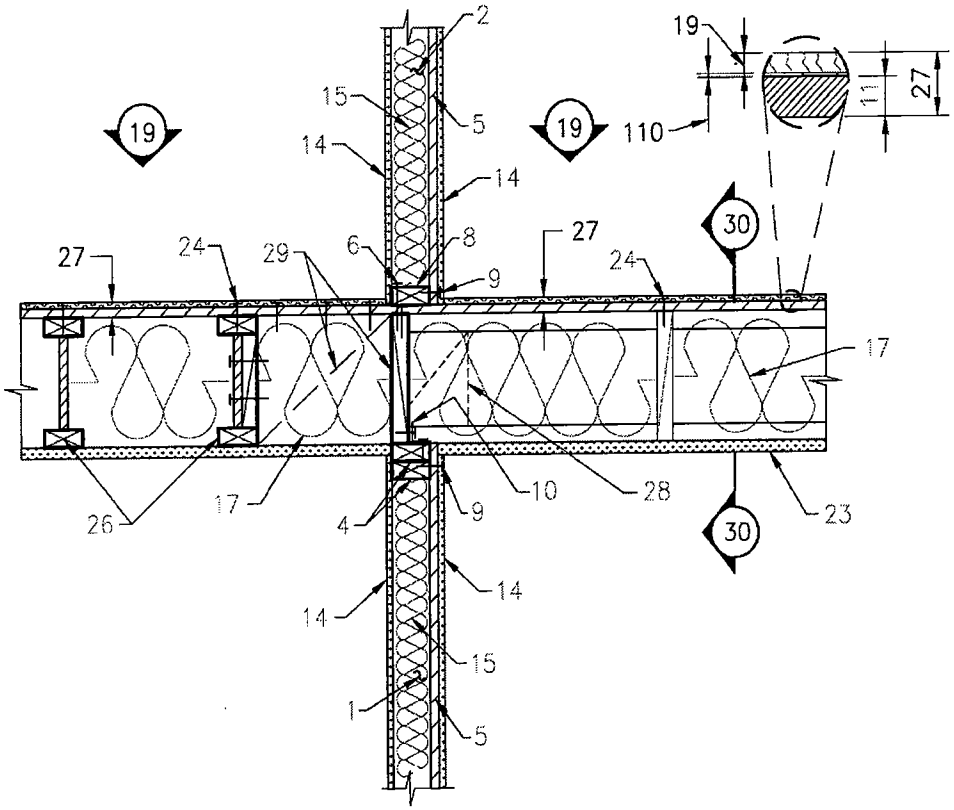
FIGS. 22-28 are various cross-sectional views, partially enlarged, cut at floor level of an engineered wood frame building through the exterior bearing shear wall.
Figure 22:
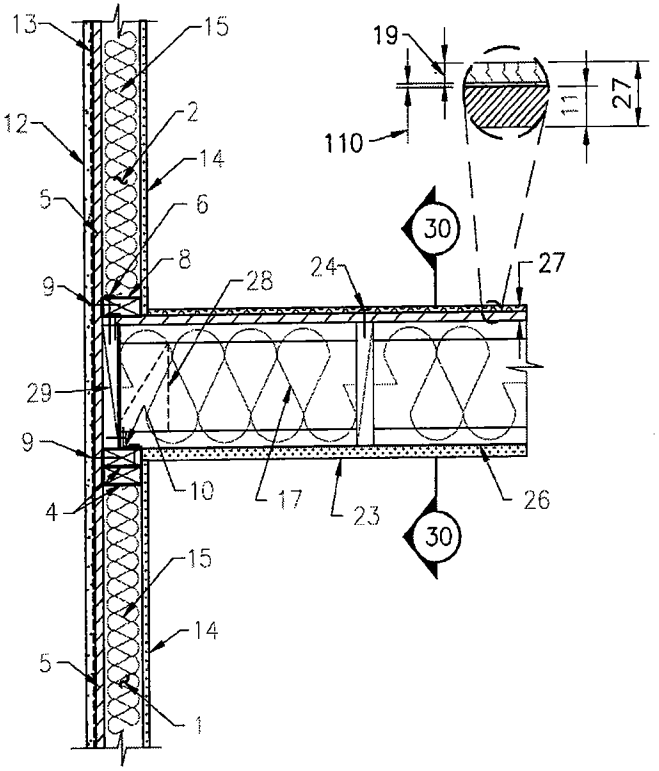
Figure 24:
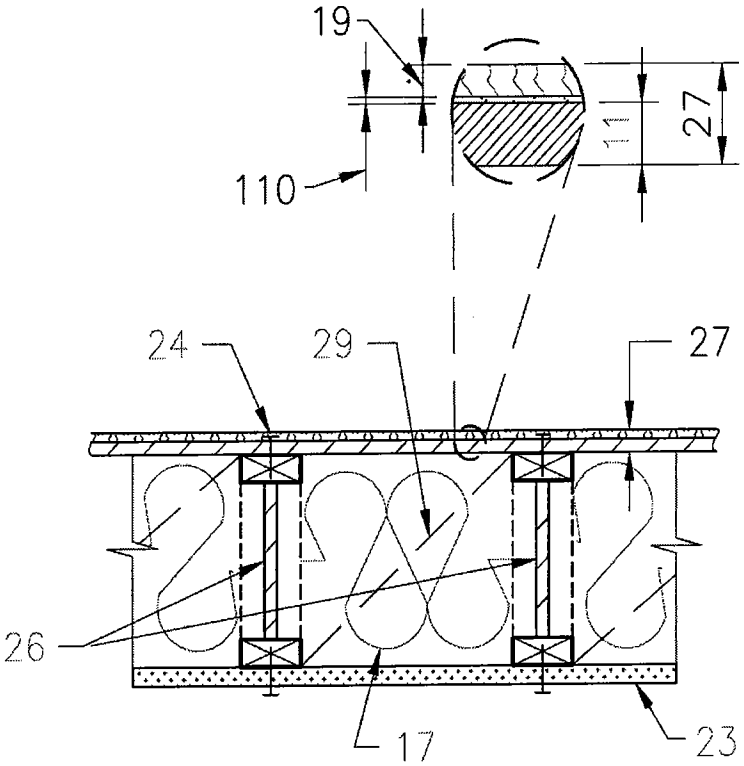

FIG. 21 shows typical cross-sectional cut through the new or existing floor in the direction perpendicular to the wood floor joists 3, with the composite membrane of structural wood floor diaphragm 27 shown on top of floor joists 3 and attached to the floor joists 3 with fasteners 24. Blocking 7 between the floor joists 3 is schematically shown beyond. FIG. 24 is similar to FIG. 21, however engineered wood joist 26 is shown instead of wood joist 3, and blocking 29 is shown instead of blocking 7.

Multi-purpose fire and sound-proof insulation 17 shown in FIGS. 19-28 offers a floor-to-floor noise blocking barrier that operates in the high 80s decibel or even 90s decibel range. The special floor multi-purpose fire and sound proof barrier 17 is installed in the space available between:

a) The floor joists 3 per FIG. 19, FIG. 20, FIG. 21, FIG. 25, FIG. 26; and b) Engineered wood floor joists 26 per FIG. 22, FIG. 23, FIG. 24, FIGS. 27 and 28.

In all cases, insulation 17 shall be mounted prior to the installation or re-installation (in case of existing building rehabilitation) of ceiling sheathing 23.

Figure 30:
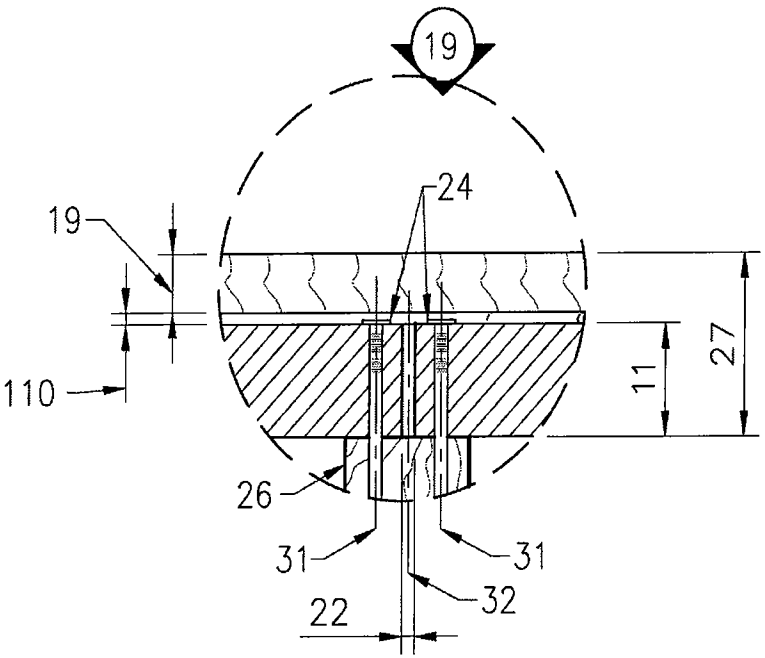
FIG. 29 and FIG. 30 are enlarged portions of the cross-sectional view of a mosaic parquet floor system installed over the edge spacing of plywood panels located over the wood floor joist.
Figure 29:
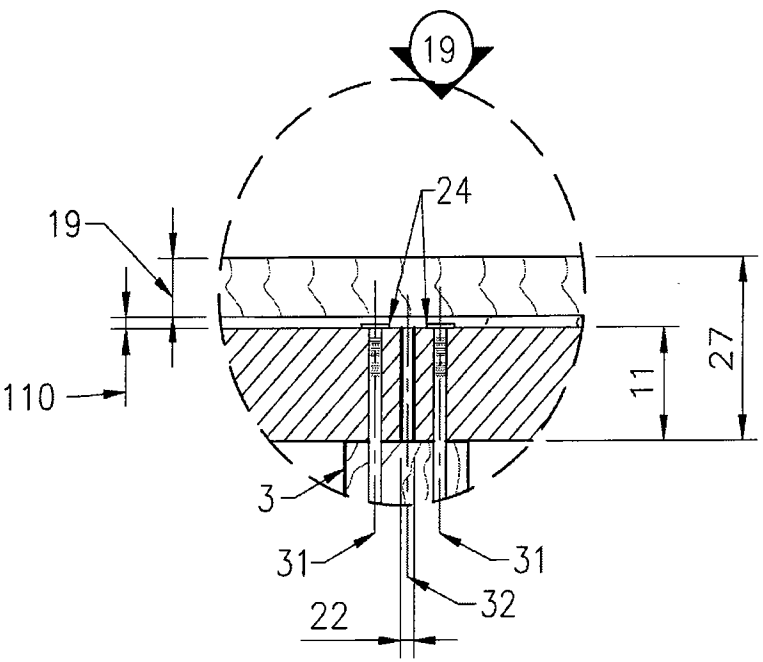

FIG. 29 shows an enlarged portion of the cross-sectional cut through the new or existing floor of a wood framed structure improved with the composite membrane 27, comprised of a four-way interlocking end grain mosaic parquet floor system 19 diagonally installed over the plywood subfloor 11 by means of a high strength adhesive 110. FIG. 29 specifically depicts the typical area where an element of the installed mosaic parquet floor system 19 bridges over the edge spacing 22 of the plywood panels 11 located directly over the wood floor joist 3. Flooring material 19 is installed over the plywood subfloor 11 diagonally for structural reasons discussed above. Plywood sheathing 22 is attached to the framing below with fasteners 24. FIG. 30 is similar to FIG. 29; however an engineered wood joist 26 is shown on FIG. 30 instead of the wood joist 3 per FIG. 29.

I claim:

1. An interlocking parquet flooring comprising:

a first panel comprising:

a plurality of long boards, each having a length greater than its width, the plurality of long boards arranged alternately longitudinally and transversely, where the transversely oriented long boards' length is bisected by adjoining longitudinal long boards, in a repeating pattern;

a plurality of square boards, each having a length approximately equal to a width of the long boards, placed at each corner of an intersection between the longitudinal and transverse long boards;

a second panel comprising:

a plurality of long boards, each having a length greater than its width, the plurality of long boards arranged alternately longitudinally and transversely, where the transversely oriented long boards' length is bisected by adjoining longitudinal long boards, in a repeating pattern;

a plurality of square boards, each having a length approximately equal to a width of the long boards, placed at each corner of an intersection between the longitudinal and transverse long boards; and a coupling unit that connect the first panel to the second panel, comprising a plurality of long boards, each having a length greater than its width, the plurality of long boards arranged alternately longitudinally and transversely, where the transversely oriented long boards' length is bisected by adjoining longitudinal long boards, in a repeating pattern;

wherein the coupling unit mates with respective opposing sides of the first and second panels to create a single, interlocking parquet flooring.

2. The interlocking parquet flooring of claim 1, further comprising a sheet of adhesive tape applied to a first surface to hold the boards together.

3. The interlocking parquet flooring of claim 1 wherein the boards are made from Douglas fir.

4. The interlocking parquet flooring of claim 1 wherein the boards have a length to width ratio of approximately 1:3.

5. The interlocking parquet flooring of claim 3, wherein the boards are heat treated to a temperature of over two hundred degrees Celsius prior to forming a panel.

6. The interlocking parquet flooring of claim 5, wherein the heat treatment temperature is selected to provide a desired color of the boards after the heat treatment.

7. The interlocking parquet flooring of claim 1 wherein the flooring is bonded to a plywood subfloor, and where the parquet flooring panels are laid diagonally over junctures in the plywood subfloor.

8. The interlocking parquet flooring of claim 7, wherein a bonding material is colored to match growth rings of the boards after finishing.

9. An interlocking parquet flooring comprising:

a first panel comprising:

a plurality of long boards, each having a length greater than its width, the plurality of long boards arranged in subunits of alternately longitudinally and transversely, where the transversely oriented subunits of long boards' length are bisected by adjoining subunits of longitudinal long boards, in a repeating pattern;

a plurality of square boards, each having a length approximately equal to a width of the long boards, placed at each corner of an intersection between the pairs of longitudinal and transverse long boards;

a second panel comprising:

a plurality of long boards, each having a length greater than its width, the plurality of long boards arranged in subunits of alternately longitudinally and transversely, where the transversely oriented subunits of long boards' length are bisected by adjoining subunits of longitudinal long boards, in a repeating pattern;

a plurality of square boards, each having a length approximately equal to a width of the long boards, placed at each corner of an intersection between the subunits of longitudinal and transverse long boards; and a coupling unit that connect the first panel to the second panel, comprising a plurality of subunits of long boards, each long board having a length greater than its width, the plurality of subunits of long boards arranged alternately longitudinally and transversely, where the transversely oriented subunit of long boards' length is bisected by adjoining pair of longitudinal long boards, in a repeating pattern;

wherein the coupling unit mates with respective opposing sides of the first and second panels to create a single, interlocking parquet flooring.

10. The interlocking parquet flooring of claim 9, further comprising a sheet of adhesive tape applied to a first surface to hold the boards together.

11. The interlocking parquet flooring of claim 9 wherein the boards are made from Douglas fir.

12. The interlocking parquet flooring of claim 9 wherein the boards have a length to width ratio of approximately 1:3.

13. The interlocking parquet flooring of claim 9, wherein the boards are heat treated to a temperature of over two hundred degrees Celsius prior to forming a panel.

14. The interlocking parquet flooring of claim 13, wherein the heat treatment temperature is selected to provide a desired color of the boards after the heat treatment.

15. The interlocking parquet flooring of claim 9 wherein the flooring is bonded to a plywood subfloor, and where the parquet flooring panels are laid diagonally over junctures in the plywood subfloor.

16. The interlocking parquet flooring of claim 15 wherein a bonding material is colored to match growth rings of the boards after finishing.

* * * * *